US009022749B2

(12) United States Patent
Akiyama et al.

(10) Patent No.: US 9,022,749 B2
(45) Date of Patent: May 5, 2015

(54) SWING DRIVE CONTROLLING SYSTEM FOR CONSTRUCTION MACHINE

(75) Inventors: Teruo Akiyama, Kokubunji (JP); Hisashi Asada, Yokohama (JP); Jin Kitajima, Yokohama (JP); Kazuhiro Maruta, Kawaguchi (JP); Takeshi Ooi, Oisi-machi (JP); Masashi Ichihara, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 816 days.

(21) Appl. No.: 12/935,641

(22) PCT Filed: Mar. 30, 2009

(86) PCT No.: PCT/JP2009/056528

§ 371 (c)(1),
(2), (4) Date: Sep. 30, 2010

(87) PCT Pub. No.: WO2009/123134

PCT Pub. Date: Oct. 8, 2009

(65) Prior Publication Data

US 2011/0020146 A1 Jan. 27, 2011

(30) Foreign Application Priority Data

Mar. 31, 2008 (JP) ..... 2008-092578

(51) Int. Cl.
*E02F 9/22* (2006.01)
*E02F 9/12* (2006.01)
*F15B 11/05* (2006.01)

(52) U.S. Cl.
CPC ..... *E02F 9/2235* (2013.01); *E02F 9/123* (2013.01); *E02F 9/2285* (2013.01);
(Continued)

(58) Field of Classification Search
CPC ..... E02F 9/2296; E02F 9/2235; E02F 9/2285; E02F 9/123; F15B 11/055; F15B 2211/7058; F15B 2211/20546; F15B 2211/26; F15B 2211/3052; F15B 11/3116; F15B 11/31576; F15B 2211/329; F15B 2211/50518; F15B 2211/6309; F15B 2211/6316; F15B 2211/6333
USPC ..... 417/212, 213, 218, 222.1, 270; 60/452, 60/468; 180/52.1, 53.2, 53.3, 53.4, 53.5, 180/53.6, 53.7, 53.8
See application file for complete search history.

(56) References Cited

U.S. PATENT DOCUMENTS 3,999,387 A * 12/1976 Knopf ..... 60/444
4,809,504 A * 3/1989 Izumi et al. ..... 60/430
(Continued)

FOREIGN PATENT DOCUMENTS

CN 1670316 A 9/2005
EP 1 577 566 B1 12/2010
(Continued)

OTHER PUBLICATIONS

Machine Translation of JP 2009-362299A, Inventor Yoshikawa et al., Japan Feb. 2009.*
(Continued)

*Primary Examiner* — Charles Freay
*Assistant Examiner* — Lilya Pekarskaya
(74) *Attorney, Agent, or Firm* — Holtz, Holtz, Goodman & Chick PC

(57) ABSTRACT

The system includes: a variable displacement hydraulic pump supplying pressure oil to a hydraulic actuator; a pressure detector detecting a pump discharge pressure from the hydraulic pump; a control valve controlling a supply of the pressure oil to the hydraulic actuator; a controller controlling a pump displacement of the hydraulic pump; a hydraulic motor rotating an upper structure of the construction machine; a swing relief valve defining a relief pressure of the hydraulic motor; and a control lever switching a control valve for the hydraulic motor. The controller includes: an adjuster that, when a pump discharge pressure detected by the pressure detector exceeds a first set value, conducts an adjustment to reduce the pump displacement; and a canceller that cancels the adjustment when the pump discharge pressure falls below a second set value. The second set value is equal to or larger than the first set value.

7 Claims, 15 Drawing Sheets

(52) U.S. Cl.
CPC ..... *E02F 9/2296* (2013.01); *F15B 11/055* (2013.01); *F15B 2211/20546* (2013.01); *F15B 2211/26* (2013.01); *F15B 2211/3052* (2013.01); *F15B 2211/3116* (2013.01); *F15B 2211/31576* (2013.01); *F15B 2211/329* (2013.01); *F15B 2211/50518* (2013.01); *F15B 2211/6309* (2013.01); *F15B 2211/6316* (2013.01); *F15B 2211/6333* (2013.01); *F15B 2211/6346* (2013.01); *F15B 2211/7058* (2013.01)

(56) References Cited

U.S. PATENT DOCUMENTS

| | | | | | |
|---|---|---|---|---|---|
| 4,846,046 | A * | 7/1989 | Kanai et al. | 91/506 |
| 4,967,557 | A * | 11/1990 | Izumi et al. | 60/423 |
| 5,048,293 | A * | 9/1991 | Aoyagi | 60/420 |
| 5,343,779 | A * | 9/1994 | Nikolaus et al. | 74/733.1 |
| 5,636,516 | A * | 6/1997 | Kon | 60/466 |
| 5,784,883 | A * | 7/1998 | Ohkura et al. | 60/327 |
| 6,282,890 | B1 * | 9/2001 | Takano | 60/420 |
| 7,165,950 | B2 * | 1/2007 | Fenny et al. | 417/270 |
| 7,392,653 | B2 * | 7/2008 | Sugano | 60/452 |
| 7,954,315 | B2 * | 6/2011 | Yamashita | 60/421 |
| 7,979,182 | B2 * | 7/2011 | Ooki et al. | 701/50 |
| 8,056,331 | B2 * | 11/2011 | Kakizawa et al. | 60/431 |
| 2004/0231326 | A1 | 11/2004 | Imanishi et al. | |
| 2005/0204735 | A1 * | 9/2005 | Sugano | 60/452 |
| 2010/0186402 | A1 * | 7/2010 | Ariga et al. | 60/329 |

FOREIGN PATENT DOCUMENTS

| | | | |
|---|---|---|---|
| JP | 57-116966 | A | 7/1982 |
| JP | 59-85046 | A | 5/1984 |
| JP | 5-172107 | A | 7/1993 |
| JP | 2001-50202 | A | 2/2001 |
| JP | 2003-294003 | A | 10/2003 |
| JP | 2004-347040 | A | 12/2004 |
| JP | 2005-90354 | A | 4/2005 |
| JP | 2005-265002 | A | 9/2005 |
| JP | 2009-36299 | A * | 2/2009 |

OTHER PUBLICATIONS

International Search Report dated May 12, 2009 issued in International Appln. No. PCT/JP2009/56528.

German Office Action dated Dec. 27, 2011 in counterpart German Application No. 11 2009 000 713.9.

Chinese Office Action dated Jan. 14, 2013 (and English transition thereof) in counterpart Chinese Application No. 200980111681.6.

* cited by examiner

SWING DRIVE CONTROLLING SYSTEM FOR CONSTRUCTION MACHINE

TECHNICAL FIELD

This application is a U.S. National Phase Application under 35 USC 371 of International Application PCT/JP2009/056528 filed Mar. 30, 2009.

The present invention relates to a swing drive controlling system for a construction machine for driving a hydraulic swing motor for rotating an upper structure of a construction machine while controlling a relief flow rate discharged without being used for driving the hydraulic swing motor.

BACKGROUND ART

In a top-swinging construction machine such as a hydraulic excavator, an upper structure is swingably attached to a lower vehicle body (base carrier) provided with a carrier. A working equipment including a boom, an arm, a bucket or the like is pivotally mounted to the upper structure. The base carrier is driven by a travel hydraulic motor while the upper structure is swung by a hydraulic swing motor. The boom, arm, bucket and the like are pivoted respectively by a boom cylinder, an arm cylinder, a bucket cylinder and the like.

Pressure oil discharged from a variable displacement hydraulic pump driven by an engine is supplied to or discharged from hydraulic actuators of the hydraulic motors and the cylinders via control valves provided corresponding to the actuators. The pump displacement of the variable displacement hydraulic pump is controlled according to a load pressure and a pump discharge pressure of the hydraulic actuator and the position of the control valve.

For instance, the pump displacement of the hydraulic pump is controlled in accordance with a load-sensing differential pressure between the load pressure of the hydraulic actuator and the discharge pressure of the hydraulic pump. In addition, the pump displacement of the hydraulic pump is controlled so that a pump absorption torque (pump displacement of the hydraulic pump×pump discharge pressure of the hydraulic pump) becomes a predetermined value or less.

Specifically, when the hydraulic actuator requires a large amount of pump discharge flow in accordance with the load-sensing differential pressure, the pump displacement of the hydraulic pump is controllably enlarged. On the other hand, when the hydraulic actuator does not require a large amount of pump discharge flow or the control valve is returned to a neutral position (i.e. a position at which the pressure oil is not supplied to the hydraulic motor and the cylinder), the pump displacement of the variable displacement hydraulic pump is controllably reduced.

The pump displacement is controlled so that the pump is capable of discharging a flow rate required by the hydraulic actuator. By thus controlling the pump displacement of the variable displacement hydraulic pump in accordance with load-sensing differential pressure, when the pressure oil is not necessary to be supplied to the hydraulic actuators such as those of the hydraulic motor and the cylinder, the pump displacement of the variable displacement hydraulic pump can be set at the minimum. Accordingly, the consumption power of the engine for driving the variable displacement hydraulic pump can be reduced.

A target pump displacement for controlling the pump displacement of the hydraulic pump can be set, for instance, in accordance with a relationship between a target pump absorption torque of the hydraulic pump and the pump discharge pressure of the hydraulic pump or in accordance with an operation amount of a control lever for operating a hydraulic swing motor for driving the upper structure.

Generally, a relational expression of D=T/P is established between a pump displacement D, pump absorption torque T and pump discharge pressure P of a hydraulic pump. Though a constant is required between a right-hand member and a left-hand member of the relational expression, the constant is omitted in the above relational expression. According to the relational expression, the target pump displacement corresponding to the current pump discharge pressure P can be determined in accordance with the target pump absorption torque T. Incidentally, the target pump absorption torque is generally set in accordance with the engine speed at each time period.

Alternatively, the target pump displacement corresponding to the operation amount of the control lever for operating the hydraulic swing motor may be determined through experiments or the like, thereby setting the target pump displacement corresponding to detected operation amount of the control lever. In accordance with the detected operation amount of the control lever, a swash plate angle of the hydraulic pump can be controlled so that the pump displacement of the hydraulic pump is set at the target pump displacement.

The target pump absorption torque of the hydraulic pump is thus controlled, so that, the pump displacement is reduced when the pump discharge pressure is high and, the pump displacement is increased when the pump discharge pressure is low. The target pump absorption torque of the hydraulic pump is set in accordance with the output condition of the engine (full output and partial output). Since the target pump absorption torque is thus controlled, the overload of the engine for driving the variable displacement hydraulic pump and consequent engine failure are prevented.

When, for instance, a hydraulic swing motor for driving the upper structure of a hydraulic excavator is exemplified, an operation on a pilot valve for swing movement switches a position of a control valve for the hydraulic swing motor (this control valve for hydraulic swing motor will be referred to as a swing control valve hereinafter) from a neutral position to feed the pressure oil discharged from the hydraulic pump toward the hydraulic swing motor. Then, the upper structure of the hydraulic excavator is swung by the drive of the hydraulic swing motor.

When the swing control valve of the hydraulic swing motor is switched, the pump displacement of the hydraulic pump is controlled to be a pump displacement corresponding to the load-sensing differential pressure (a differential pressure between a pump discharge pressure and a load pressure of the hydraulic swing motor) applied on a load sensing valve for controlling the pump displacement of the hydraulic pump. In other words, when the swing control valve is switched, the hydraulic pump is immediately (normally within approximately 0.2 to 0.3 second) controlled so as to increase the pump displacement.

Incidentally, the same function also works not only in the above load-sensing hydraulic circuit but also in an open-center hydraulic circuit.

However, since an inertial force for keeping the upper structure at halt is large, it takes some time before the upper structure is accelerated from the halted state to a steady swing velocity (a state at which all of the pump discharge amount commanded by the swing control valve flows toward the hydraulic swing motor). Normally two to three seconds are required for a startup time required for accelerating from the halted state to the steady swing velocity.

Accordingly, during the time until the upper structure is accelerated to the steady swing velocity, a part of the pressure oil discharged from the hydraulic pump is not used for driving the hydraulic motor but is discharged from a swing relief valve to be wasted as an extra flow during the acceleration of the upper structure is accelerating. The wasteful discharge of the pressure oil discharged from the hydraulic pump results in deterioration of fuel consumption of the engine, a temperature increase in the hydraulic oil, an increase in relief noise and the like.

In order to control the relief flow rate, a hydrostatic drive device (see Patent Document 1), a hydraulic circuit of a construction machine (see Patent Document 2), a hydraulic control device of a hydraulic working equipment (see Patent Document 3) and the like are proposed. The solution disclosed in Patent Document 1 applies a swing acceleration pressure on a side of a springbox of a swing control valve (referred to as a parallel narrowing part in Patent Document 1) opposite to a spool-drive side. The spool of the swing control valve is returned to a position at which the swing acceleration pressure and the spring force are balanced to reduce the relief flow rate.

The solution disclosed in Patent Document 2 employs a regulator for controlling a pump displacement of a variable displacement hydraulic pump of an open-center hydraulic circuit. The regulator is controlled by higher one of: remnant discharge pressure of a discharge pressure from a hydraulic pump after being used by an actuator; and a pilot pressure outputted by a proportional solenoid valve controlled by a controller. The controller outputs a command signal for controlling the proportional solenoid valve in accordance with a detection value of the pump discharge pressure discharged by the variable displacement hydraulic pump.

When the controller detects an operation on a swing control valve (referred to as a switch control valve in Patent Document 2), the controller outputs to the proportional solenoid valve a pilot pressure for reducing the pump displacement of the variable displacement hydraulic pump in accordance with the detected pump discharge pressure.

Patent Document 3 discloses a hydraulic pressure controller for a hydraulic working equipment that is adapted to cutting off a discharge flow rate of a variable displacement hydraulic pump for supplying pressure oil for driving an actuator, in which a relief valve of a swing motor is provided by a variable swing relief valve. When a working pressure exceeds a cutoff set pressure, an absorption torque of the variable displacement hydraulic pump is decreased. When the absorption torque of the variable displacement hydraulic pump is decreased, the relief pressure of the variable swing relief valve is increased by a predetermined pressure.

[Patent Document 1] JP-A-1982-116966
[Patent Document 2] JP-A-2003-294003
[Patent Document 3] JP-A-2001-50202

DISCLOSURE OF THE INVENTION

Problems to be Solved by the Invention

In Patent Document 1, the swing acceleration pressure is fed back as a pressure for driving a spool of the swing control valve. Accordingly, the swing acceleration pressure becomes unstable, thus causing a hunting.

Patent Document 2 is silent on a load-sensing system. Further, when a variable displacement hydraulic pump is used, it is requisite for torque-restriction control to coexist. However, the torque-restriction control is not disclosed.

In addition, Patent Documents 1 and 2 neither disclose nor hint a function of the swing relief valve for minimizing the relief flow rate and keeping the pump discharge pressure applied to the hydraulic swing motor at the maximum pressure.

Further, when the used swing relief valve is structured so that the relief pressure is decreased in accordance with a decrease in the relief flow rate discharged from the swing relief valve, a control on the hydraulic pump for decreasing the relief flow rate causes a decrease in the pump discharge pressure supplied to the hydraulic motor, thereby reducing the swing torque for driving the upper structure. When the swing torque is decreased, an acceleration performance for accelerating the upper structure is deteriorated. Under the above circumstances, the swing of the upper structure decreases a lateral-press force for laterally pressing the working equipment to an object.

In Patent Document 3, it is disclosed that a decrease in working force of the swing motor is restrained by increasing a relief pressure of the variable swing relief valve by a predetermined pressure when the relief flow rate is decreased. However, the decrease in the absorption torque of the variable displacement hydraulic pump and the increase in the relief pressure of the variable swing relief valve are simultaneously conducted. Accordingly, the change in the discharge flow rate of the variable displacement hydraulic pump and the change in override characteristics of the variable swing relief valve simultaneously occur to change the flow rate supplied to the swing motor, thereby causing a shock on account of change in a swing velocity.

An object of the invention is, unlike those in conventional hydraulic devices, to provide a swing drive controlling system of a construction machine that is capable of controlling a relief flow that has been dumped without being used in accordance with a drive condition of the upper structure. Another object of the invention is to provide a swing drive controlling system of a construction machine that is suitably applicable to an electronic pump in which the pump displacement of a variable displacement hydraulic pump can be directly designated by an electric command and applicable to a torque-restricting hydraulic pump, and is capable of preventing decrease in pump discharge pressure to a hydraulic swing motor by controlling the relief flow rate so that the upper structure can favorably swing even when a swing relief valve with poor override characteristics (i.e. a relationship between an input pressure and a passing flow rate of the relief valve) is provided.

Means for Solving the Problems

The problems of the invention can be solved by inventions described hereinbelow.

A swing drive controlling system according to an aspect of the invention includes: a variable displacement hydraulic pump that is driven by an engine, the variable displacement hydraulic pump supplying pressure oil to a hydraulic actuator; a pressure detector that detects a pump discharge pressure from the hydraulic pump; a control valve that controls a supply of the pressure oil discharged by the hydraulic pump to the hydraulic actuator; a controller that controls a pump displacement of the hydraulic pump; a hydraulic motor provided by a part of the hydraulic actuator, the hydraulic motor rotating an upper structure of the construction machine; a swing relief valve that defines a relief pressure of the hydraulic motor; and a control lever that switches a first control valve for the hydraulic motor that is provided by a part of the control valve, in which the controller comprises: a adjuster that, when a pump discharge pressure detected by the pressure detector exceeds a first set value while operating the control lever, conducts an adjustment to reduce the pump displacement in accordance with the pump discharge pressure; and a canceller that cancels the adjustment by the adjuster when the pump discharge pressure detected by the pressure detector falls below a second set value, and the second set value is equal to or larger than the first set value.

In the swing drive controlling system of a construction machine according to the above aspect of the invention, it is preferable that a lever operation amount detector that detects a lever operation amount of the control lever is provided; the swing relief valve is a two-stage swing relief valve that is adapted to set a first relief pressure and a second relief pressure higher than the first relief pressure; a solenoid switch that switches a set pressure of the two-stage swing relief valve is provided; the controller comprises: a determining unit that determines that the upper structure is accelerating based on the lever operation amount detected by the lever operation amount detector and the pump discharge pressure detected by the pressure detector; and a swing relief pressure switch that, when the pump discharge pressure detected by the pressure detector exceeds a third set value, switches the set pressure of the two-stage swing relief valve from the first relief pressure to the second relief pressure and, when the pump discharge pressure detected by the pressure detector falls below a fourth set value, switches the relief pressure of the two-stage swing relief valve from the second relief pressure to the first relief pressure; the third set value is smaller than the first set value, the fourth set value is equal to or smaller than the second set value; and the solenoid switch switches the set pressure of the two-stage swing relief valve based on a switching signal from the swing relief pressure switch.

Further, in the swing drive controlling system of a construction machine according to the above aspect of the invention, it is preferable that, when a second control valve other than the first control valve for the hydraulic motor is switched while the adjuster of the controller is reducing the pump displacement in accordance with the pump discharge pressure detected by the pressure detector, the controller cancels the adjustment by the adjuster.

Furthermore, in the swing drive controlling system of a construction machine according to the above aspect of the invention, it is preferable that the controller comprises a lever-return determining unit that judges whether the control lever for switching the first control valve for the hydraulic motor is returned in a neutral direction while operating the control lever, and when the lever-return determining unit judges that the control lever for switching the first control valve for the hydraulic motor is returned in the neutral direction while operating the control lever, the swing relief pressure switch switches the set pressure of the two-stage swing relief valve that is set at the second relief pressure to the first relief pressure.

In addition, in the swing drive controlling system of a construction machine according to the above aspect of the invention, it is preferable that the controller comprises a lever-shift-back determining unit that judges whether the control lever for switching the first control valve for the hydraulic motor is operated beyond a neutral position in an opposite direction while operating the control lever, and when the lever-shift-back determining unit judges that the control lever for switching the first control valve for the hydraulic motor is operated beyond the neutral position in the opposite direction while operating the control lever, the swing relief pressure switch switches the set pressure of the two-stage swing relief valve that is set at the second relief pressure to the first relief pressure.

Further, in the swing drive controlling system of a construction machine according to the above aspect of the invention, it is preferable that, when a control valve other than the first control valve for the hydraulic motor is switched while the adjuster of the controller is reducing the pump displacement in accordance with the pump discharge pressure detected by the pressure detector, the controller cancels a switching from the first relief pressure to the second relief pressure by the swing relief pressure switch.

Furthermore, in the swing drive controlling system of a construction machine according to the above aspect of the invention, it is preferable that the adjuster comprises: an elapsed time judging unit that judges whether a time elapsed since the pump discharge pressure exceeds the first set value is within a predetermined time or not; and a response characteristics setting unit that sets response characteristics of the pump displacement in response to the pump discharge pressure, and the response characteristics setting unit sets the response characteristics in a direction for reducing the pump displacement in response to a change in the pump discharge pressure so that the response characteristics are delayed after the predetermined time is elapsed relative to the response characteristics before the predetermined time is elapsed.

Advantages of the Invention

In the swing drive controlling system of a construction machine according to the above aspect of the invention, useless consumption of the discharge flow discharged from a hydraulic pump that is controlled to provide a preset pump absorption torque according to the pump discharge pressure of the hydraulic pump or from an electronic pump of which pump displacement can be directly designated by an electric signal can be reduced. Further, in the aspect of the invention, substantially the same operability in swinging the upper structure as that without reducing the discharge flow rate as in the aspect of the invention can be provided.

Specifically, when the pump discharge pressure of the hydraulic pump exceeds the first set value while operating the swing control lever, the value of the target pump displacement for controlling the pump displacement of the hydraulic pump can be reduced by the adjustment by the adjuster in accordance with the pump discharge pressure. Thus, the flow discharged without being used for driving the hydraulic swing motor can be reduced substantially without changing the pump discharge flow for driving the hydraulic swing motor.

Further, when the pump discharge pressure falls below the second set value that is higher than the first set value, the adjustment conducted by the adjuster for reducing the value of the target pump displacement in accordance with the pump discharge pressure is canceled by the canceller, so that the pump discharge flow discharged from the hydraulic pump can be returned to the same pump discharge flow as that without conducting the adjustment. The pump discharge pressure falls below the second set value when, for instance, the upper structure has been accelerated to a steady swing velocity.

In the steady swing, the inertial force for keeping the swing of the upper structure becomes large and the flow dumped through the swing relief valve becomes zero, so that all of the pump discharge flow discharged from the hydraulic pump is used for swing drive. If the adjustment is continued when all of the pump discharge flow is used for swing drive, the pump discharge flow runs short so that the pump pressure significantly decreases as compared with a conventional arrangement.

However, since the adjustment is canceled when the pump pressure falls below the second set value in the above aspect of the invention, the shortage of the pump discharge flow or the decrease in the pump pressure is not caused, thereby operating the hydraulic swing motor in the same manner as an instance without conducting the adjustment.

The second set value for cancelling the adjustment has to be set sufficiently higher than the pump pressure during the steady swing velocity. On the other hand, the higher the second set value for cancelling the adjustment is, the more easily the adjustment is canceled, thereby showing little advantages.

In the aspect of the invention, since the first set value at which the adjustment is started is equal to or lower than the second set value, the adjustment can be easily started. Further, when the second set value is set high, the time for the adjustment can be set long, thereby enhancing the advantages.

As described above, the adjuster and the canceller of the aspect of the invention allow minute control of the pump displacement of the hydraulic pump. Specifically, when the swing velocity of the upper structure is accelerating, the pump displacement of the hydraulic pump can be controlled according to the target pump displacement until the pump discharge pressure exceeds the first set value, thereby rapidly actuating the hydraulic swing motor.

When the pump discharge pressure falls below the first set value while the swing velocity of the upper structure is accelerating, the value of the target pump displacement can be adjusted to be smaller by the adjuster. Thus, the flow discharged without being used for driving the hydraulic swing motor can be reduced by controlling the pump displacement of the hydraulic pump.

When the pump discharge pressure falls below the second set value, since the adjustment for reducing the target pump displacement in accordance with the pump discharge pressure is canceled, all of the pump discharge flow discharged from the hydraulic pump is used for driving the hydraulic swing motor as described above, so that the same operability as that in the conventional arrangement can be obtained.

Hence, the pump displacement of the hydraulic pump can be controlled substantially without exerting an adverse effect on a swing performance of the hydraulic swing motor for swinging the upper structure. Further, the flow uselessly discharged without being used for driving the hydraulic swing motor can be reduced. Accordingly, deterioration in the fuel consumption rate of the engine, increase in the temperature of the hydraulic oil and the relief noise and the like that occurs at an early stage of starting the swing of the upper structure can be considerably improved.

Incidentally, the control of the relief flow discharged without being used for driving the hydraulic swing motor from, for instance, the swing relief valve is referred to as a "swing cutoff" in the invention.

Alternatively, the adjuster for the target pump displacement may reduce the value of the pump absorption torque that is set according to the pump discharge pressure and the canceller may cancel the adjustment conducted by the adjuster to restore the pre-adjusted pump absorption torque that is set according to the pump discharge pressure.

In the invention, when a swing relief valve with poor override characteristics is used as a part of the hydraulic device of the upper structure, the swing relief valve may be provided by a two-stage swing relief valve in which a first relief pressure and a second relief pressure higher than the first relief pressure can be set. When the pump discharge pressure exceeds a third set value lower than the first set value during the operation of a swing lever, the relief pressure of the two-stage swing relief valve may be set at the second relief pressure (high-pressure side).

With the above arrangement, even when the relief flow discharged from the swing relief valve is decreased during the swing cutoff of the invention, the decrease in the relief pressure in accordance with the decrease in the relief flow can be avoided by setting the relief pressure of the two-stage swing relief valve on the high-pressure side (the second relief pressure). Thus, the same pump discharge pressure as that without conducting the swing cutoff, i.e. the pump discharge pressure introduced to the hydraulic swing motor can be obtained.

In other words, even when a swing relief valve with poor override characteristics is used, the pump discharge pressure introduced to the hydraulic swing motor is not decreased irrespective of the decrease in the relief flow by conducting the swing cutoff of the invention.

When the pump discharge pressure falls below a fourth set value equal to or lower than the second set value, the relief pressure of the two-stage swing relief valve may be set at the first relief pressure (on the low-pressure side). The pump discharge pressure falls below the fourth set value when, for instance, the swing control lever is returned in the neutral direction to reduce the flow supplied to the swing motor and the swing motor is applied with a braking pressure.

However, since the set pressure of the two-stage swing relief valve is returned to the first relief pressure in the above aspect of the invention, an excessive braking pressure is not applied to the swing motor. Further, in the invention, the third set value is set at a value smaller than the first set value. The fourth set value is set at a value not larger than the second set value.

Accordingly, when the target pump pressure is adjusted to decrease the pump discharge flow, the set value of the relief pressure of the two-stage swing relief valve necessarily becomes that of the high-pressure side (i.e. the second relief pressure). Thus, since the first relief pressure and the second relief pressure are not switched, the pressure fluctuation caused by switching the set value of the relief pressure can be prevented, thereby avoiding a shock on account of variation of the swing velocity and the like.

In general, the override characteristics of a relief valve is used as a term representing a relationship between an input pressure to the relief valve and the relief flow discharged through the relief valve. Ideal performance required for a relief valve is that the relief valve hardly allows a fluid to flow therethrough under a certain relief pressure and does not vary an entrance side pressure thereof irrespective of increase in the relief flow beyond the certain relief pressure. A relief valve that exhibits such characteristics is called a relief valve with good override characteristics.

In contrast, a relief valve with poor override characteristics is the one that increases the entrance side pressure of the relief valve when the relief pressure exceeds a predetermined relief pressure. In other words, a relief valve with poor override characteristics is a relief valve that greatly increases the relief pressure in accordance with the increase in the relief flow rate after the discharging from the relief valve is started. However, in view of the noise when the relief flow is discharged, response speed, absolute flow rate and the like, a relief valve with poor override characteristics sometimes has to be used.

In view of the above circumstances, a swing relief valve with poor override characteristics sometimes has to be used. When the swing cutoff is conducted using a swing relief valve with poor override characteristics, the flow flowing through the swing relief valve decreases when the pump discharge amount from a hydraulic pump decreases, thereby decreasing the pressure on the entrance of the swing relief valve. Thus, with the use of the two-stage swing relief valve in the invention, the swing cutoff of the invention can be more effectively worked.

The two-stage swing relief valve may be provided by a relief valve that is adapted to change the relief pressure thereof by a solenoid switch and the like.

In the invention, when an operation other than swing operation is conducted while the adjustment is conducted, the adjustment can be canceled. With the above arrangement, the decrease in the speed of the actuator can be avoided.

In the invention, when an operation other than swing operation is conducted while the adjustment is conducted, the switching from the first relief pressure to the second relief pressure is canceled.

Accordingly, when an operation other than the swing operation is conducted and the above-described adjustment is canceled to increase the pump discharge flow, the generation of the excessive relief pressure can be avoided.

In the invention, when it is determined that the swing lever is returned to the neutral direction or the swing lever is cut back beyond the neutral direction toward an opposite side while the upper structure is swinging and it is expected that the swing braking pressure will be applied to the hydraulic swing motor, the swing relief pressure switch of the two-stage swing relief valve is controlled to switch the relief pressure to the first relief pressure (low-pressure side).

When the swing braking pressure is applied on the hydraulic swing motor while the relief pressure of the two-stage swing relief valve is set at the second relief pressure (the high-pressure side), the pressure on the discharge side of the hydraulic swing motor becomes relatively high as compared to a normal condition (i.e. when relief pressure of the two-stage swing relief valve is set at the first relief pressure (the low-pressure side)).

Then, consequent increase in the deceleration torque for decelerating the swing of the upper structure that keeps rotating by virtue of the inertial force causes too rapid deceleration of the swing of the upper structure, so that a deceleration shock is caused or the peak pressure to the hydraulic swing motor increases to shorten the lifetime of the hydraulic swing motor.

Accordingly, in the invention, when it is expected that the swing braking pressure will be applied according to the movement or the swing control lever, the relief pressure of the two-stage swing relief valve is set at the first relief pressure (low-pressure side) to prevent a high pressure oil from being applied on the hydraulic swing motor.

Thus, the deceleration of the swing of the upper structure can be slowed down, thereby avoiding the generation of the deceleration shock and extending the lifetime of the hydraulic swing motor.

Further, the increase in the braking pressure can be avoided, thus prevent the damage on the hydraulic swing motor or decrease in the lifetime of swing machineries.

According to the invention, the adjusted response characteristics of the target pump displacement are delayed in a direction for reducing the pump displacement after a predetermined time from the start of the swing cutoff operation. With the above feature, without causing a delay of the swing cutoff when the upper structure starts swing, the pressure fluctuation of the pump discharge pressure in accordance with the swing cutoff can be prevented.

In other words, when the pump discharge pressure suddenly fluctuates for some reason, the value of the target pump displacement for controlling the pump displacement of the hydraulic pump also fluctuates. When the pump displacement of the hydraulic pump is controlled based on a control signal according to the fluctuating target pump displacement, the fluctuation of the hydraulic pump displacement to be controlled is amplified. As a result, the pump discharge pressure is further greatly fluctuates to cause fluctuation in the swing velocity.

However, according to the arrangement of the invention, even when the target pump displacement is fluctuated, since the response characteristics can be delayed before being outputted, the fluctuation of the target pump displacement can be removed before being used for controlling the pump displacement of the hydraulic pump. Then, the pump displacement of the hydraulic pump controlled by the control signal based on the fluctuation-removed target pump displacement does not greatly fluctuate. The fluctuation of the pump discharge pressure can be consequently restrained, thereby stably conducting a swing operation.

Further, within a predetermined time after starting the swing cutoff, the target pump displacement in a direction for reducing the pump displacement of the hydraulic pump is outputted without delaying the response characteristics, so that the delay in the swing cutoff, i.e. the delay in the decreasing operation of the discharge flow rate, can be prevented.

As discussed above, within a predetermined time after the pump discharge pressure exceeds the first set value, the fluctuation of the pump discharge pressure by the swing cutoff can be prevented without causing the delay of the swing cutoff when the upper structure starts swing.

Further, after the predetermined time is elapsed since the pump discharge pressure exceeds the first set value, the response characteristics of the target pump displacement are delayed irrespective of the tendency for increasing/decreasing the pump displacement of the hydraulic pump. Thus, even when the pump discharge pressure is fluctuated for some reason, a smooth control signal is provided without magnifying the fluctuation, thereby allowing a control without fluctuating the pump displacement of the hydraulic pump.

BEST MODE FOR CARRYING OUT THE INVENTION

An exemplary embodiment of the invention will be specifically described below with reference to attached drawings. A swing drive controlling system for a construction machine according to the invention is suitably applied to a construction machine on which an upper structure is mounted.

The swing drive controlling system of a construction machine according to the invention can be embodied in a shape and arrangement different from those explained below as long as a problem of the invention can be solved. Accordingly, the scope of the invention is not limited to the exemplary embodiments described below but can be altered in various arrangements.

Embodiment(s)

Figure 1:
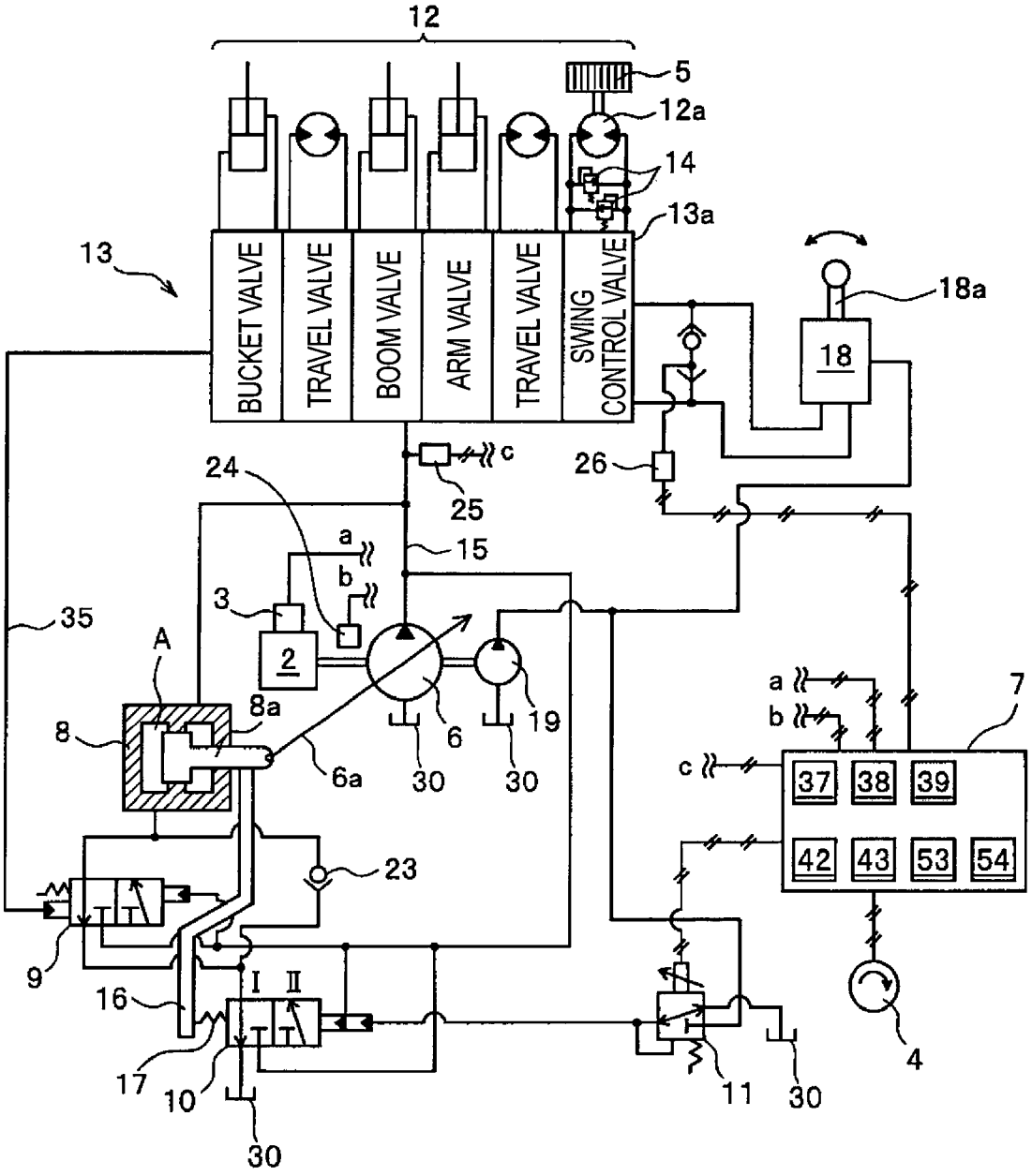
FIG. 1 is a hydraulic circuit diagram according to an exemplary embodiment of the invention (embodiment).

FIG. 1 shows a hydraulic circuit of the swing, drive controlling system for a construction machine according to an exemplary embodiment of the invention, which specifically shows a hydraulic circuit of the swing drive controlling system for an upper structure including a hydraulic swing motor for rotating the upper structure and a variable displacement hydraulic pump. An engine 2 is a diesel engine, of which engine torque is controlled by adjusting an amount of fuel injected into a cylinder of the engine 2. The fuel adjustment can be conducted by a conventionally known fuel injector 3.

A variable displacement hydraulic pump 6 (referred to as a hydraulic pump 6 hereinafter) and a pilot hydraulic pump 19 are connected to an output shaft of the engine 2. The output shaft of the engine 2 is rotated to drive the hydraulic pump 6 and the pilot hydraulic pump 19. A tilt angle of a swash plate 6*a* of the hydraulic pump 6 is controlled by a control cylinder 8. The tilt angle of the swash plate 6*a* is changed to vary a pump displacement D (cc/rev) of the hydraulic pump 6.

The control cylinder 8 is controlled by a load-sensing valve 9 that is actuated according to a differential pressure between a pump discharge pressure and a load pressure of a hydraulic actuator 12 and is controlled according to an output pressure from a torque control valve 10. The torque control valve 10 is controlled at a position at which a sum of pilot pressure outputted by a electric proportional pressure control valve 11 and a pump discharge pressure of the hydraulic pump 6 is balanced with a biasing force of a spring 17 located at an end of the torque control valve 10.

The discharge flow from the hydraulic, pump 6 is supplied to respective control valves 13 of the hydraulic actuator 12 through a discharge oil path 15. In a hydraulic excavator as an example of the construction machine, the control valves 13 include a bucket valve, a travel valve, a boom valve, an arm valve, a swing control valve 13*a* and the like.

The invention relates to a hydraulic swing motor 12*a* for driving an upper structure 5 in the hydraulic actuator 12. Accordingly, the hydraulic swing motor 12*a* and the swing control valve 13*a* for controlling the hydraulic swing motor 12*a* will be described below.

The swing control valve 13*a* is controlled in accordance with an operation of a control lever 18*a* provided to the pilot operation valve 18. The swing control valve 13*a* is operated by the control lever 18*a* to control a supply of a discharge flow from the hydraulic pump 6 to the hydraulic swing motor 12*a*, so that the hydraulic swing motor 12*a* is normally rotated, reversely rotated or stopped or the rotary speed of the hydraulic swing motor 12*a* is controlled.

Further description will be made below on a mechanism for controlling the pump displacement of the hydraulic pump 6. In the mechanism for controlling the pump displacement, the arrangement of the load-sensing valve 9 that is controlled by a load-sensing differential pressure (i.e. a differential pressure between the pump discharge pressure discharged from the hydraulic pump 6 and a load pressure of the hydraulic actuator 12) has been known.

Specifically, the load-sensing valve 9 is controlled in accordance with the load-sensing differential pressure, in which a position of a piston 8*a* of the control cylinder 8 is controlled by the hydraulic pressure from the load-sensing valve 9 and the pump discharge pressure, so that the pump displacement of the hydraulic pump 6 corresponds to the load pressure of the hydraulic actuator 12.

Incidentally, though not illustrated, in an open-center hydraulic circuit, the swash plate angle of the hydraulic pump 6 is controlled in accordance with a center bypass flow of the oil returned to a reservoir 30 after being discharged from the hydraulic pump 6 without passing through the hydraulic actuator 12.

A resultant force of the pump discharge pressure of the hydraulic pump 6 and the pilot pressure outputted by the electric proportional pressure control valve 11 is applied to an end of the spool of the torque control valve 10. The spring force of the spring 17 is applied to the other end of the spool. The spool of the torque control valve 10 is located at a position at which the resultant force and the spring force of the spring 17 are balanced.

An end of the spring 17 is in contact with the spool of the torque control valve 10. The other end of the spring 17 is in contact with a feedback lever 16 connected to the piston 8*a* of the control cylinder 8. In other words, the spring force of the spring 17 is adjusted in accordance with the position of the piston 8*a* of the control cylinder 8. The pump discharge pressure of the hydraulic pump 6 is introduced from the torque control valve 10 into the control cylinder 8 while being decompressed in accordance with the position at which the spool of the torque control valve 10 is balanced.

As described above, the pump discharge pressure of the hydraulic pump 6 and the spring force of the spring 17 are opposed in the torque control valve 10 and the feedback lever 16 extending from the control cylinder 8 is applied on the other end of the spring 17 to provide a force feedback hydraulic servo mechanism.

In order for the output pressure from the load-sensing valve 9 not to flow back to the torque control valve 10 when the output pressure from the load-sensing valve 9 is higher than the output pressure from the torque control valve 10, a check valve 23 is provided in an output oil path from the torque control valve 10.

A controller 7 outputs a command value to the fuel injector 3 so that an engine speed corresponding to a command value indicated by a fuel dial 4 is achieved while detecting the engine speed of the engine 2 by an engine speed sensor 24. Further, the controller 7 controls the electric proportional pressure control valve 11 to output the pilot pressure or to stop the output of the pilot pressure based on the detection value of the pressure sensor 25 (detector) for detecting the discharge pressure of the hydraulic pump 6 and/or the detection value of the pressure sensor 26 indicating an operation amount of the control lever 18*a* of the pilot operation valve 18. The controller 7 is provided with a lever operation amount detector 53 that detects the operation amount of the control lever 18*a* based on the detection value of the pressure sensor 26.

When the pilot pressure is outputted from the electric proportional pressure control valve 11, the torque control valve 10 is adapted to reduce the set value of the pump absorption torque T of the hydraulic pump 6.

In FIG. 1, when the pump discharge pressure P from the hydraulic pump 6 is raised to be equal to a set value by the spring force of the spring 17, the torque control valve 10 is switched from a position I to a position II. Then, the pump discharge pressure P is inputted to a large-diameter chamber A of the control cylinder 8, so that the piston 8*a* goes right (in FIG. 1) to reduce the pump displacement of the hydraulic pump 6.

Since the pump absorption torque T can be represented by a product of the pump discharge pressure P and the pump displacement D (D=T/P), the pump absorption torque T can be controlled to be substantially constant. More precisely, a feedback signal corresponding to a deviation between a target engine speed that is set by the fuel dial 4 and an actual engine speed of the engine 2 detected by the engine speed sensor 24 is sent from the electric proportional pressure control valve 11 to the torque control valve 10.

Figure 2:
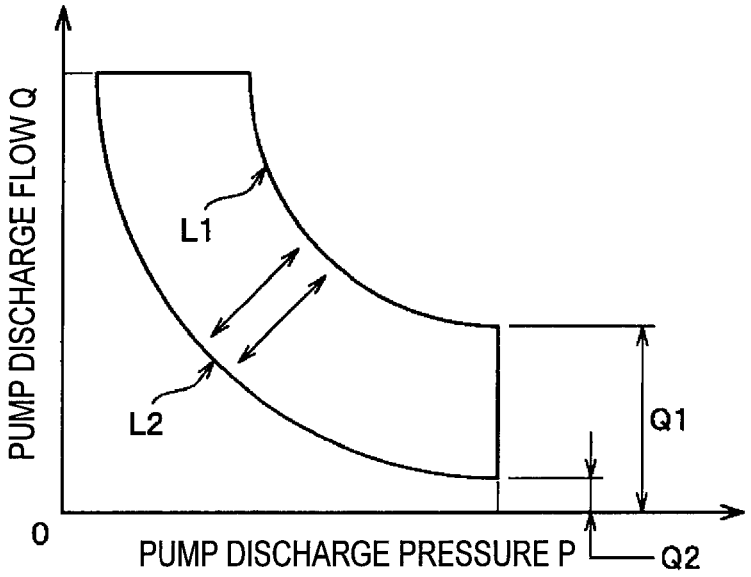
FIG. 2 is a pump absorption horse power graph of a hydraulic pump (embodiment).

The above state will be described below with reference to FIG. 2. Since the engine speed can be considered substantially constant, the vertical axis of FIG. 2 is not representative of the pump displacement D but is representative of a pump discharge flow Q (=pump displacement D×engine speed N). In other words, FIG. 2 shows pump absorption horse powers L1 and L2.

When the pilot operation valve 18 for operating the swing control valve 13*a* is operated by the control lever 18*a*, the swing control valve 13*a* is switched in accordance with the operation amount of the control lever 18*a*. When the swing control valve 13*a* is switched, the pump discharge flow from the hydraulic pump 6 is transferred to the hydraulic swing motor 12*a* to drive the upper structure 5.

At this time, when the swing control valve 13*a* is switched, the load pressure of the hydraulic swing motor 12*a* is applied on the load-sensing valve 9 through a sensing oil path 35. The load-sensing valve 9 is actuated in accordance with the load-sensing differential pressure between the pump discharge pressure P and the load-sensing pressure, so that the pump displacement D of the hydraulic pump 6 is immediately (normally within about 0.2 to 0.3 second) increased.

However, since the inertial force for keeping the upper structure 5 at halt is large, it takes some time before all of the pump discharge amount commanded by the swing control valve 13*a* flows toward the hydraulic swing motor 12*a* (steady swing velocity). It normally takes two to three seconds before the halted upper structure 5 is accelerated to the steady swing velocity.

Accordingly, while accelerating the upper structure 5 to the steady swing velocity, the pressure oil supplied to the hydraulic swing motor 12*a* is discharged from a two-stage swing relief valve 14 as a relief flow to the reservoir 30 as an extra flow. When all of the pump discharge amount discharged from the hydraulic pump 6 is dumped without being used for work, deterioration of fuel consumption of the engine 2, a temperature increase in the hydraulic oil, an increase in relief noise and the like are resulted.

At this time, it is sufficient for the two-stage swing relief valve 14 that the relief flow is minimized and the pump discharge pressure P supplied to the hydraulic swing motor 12*a* is controlled to be kept at the maximum pressure.

Accordingly, the invention is arranged so that the pump discharge pressure P supplied to the hydraulic swing motor 12*a* is kept at the maximum pressure while the relief flow discharged from the two-stage swing relief valve 14 is reduced. Specific arrangement therefor will be described below.

Figure 3:
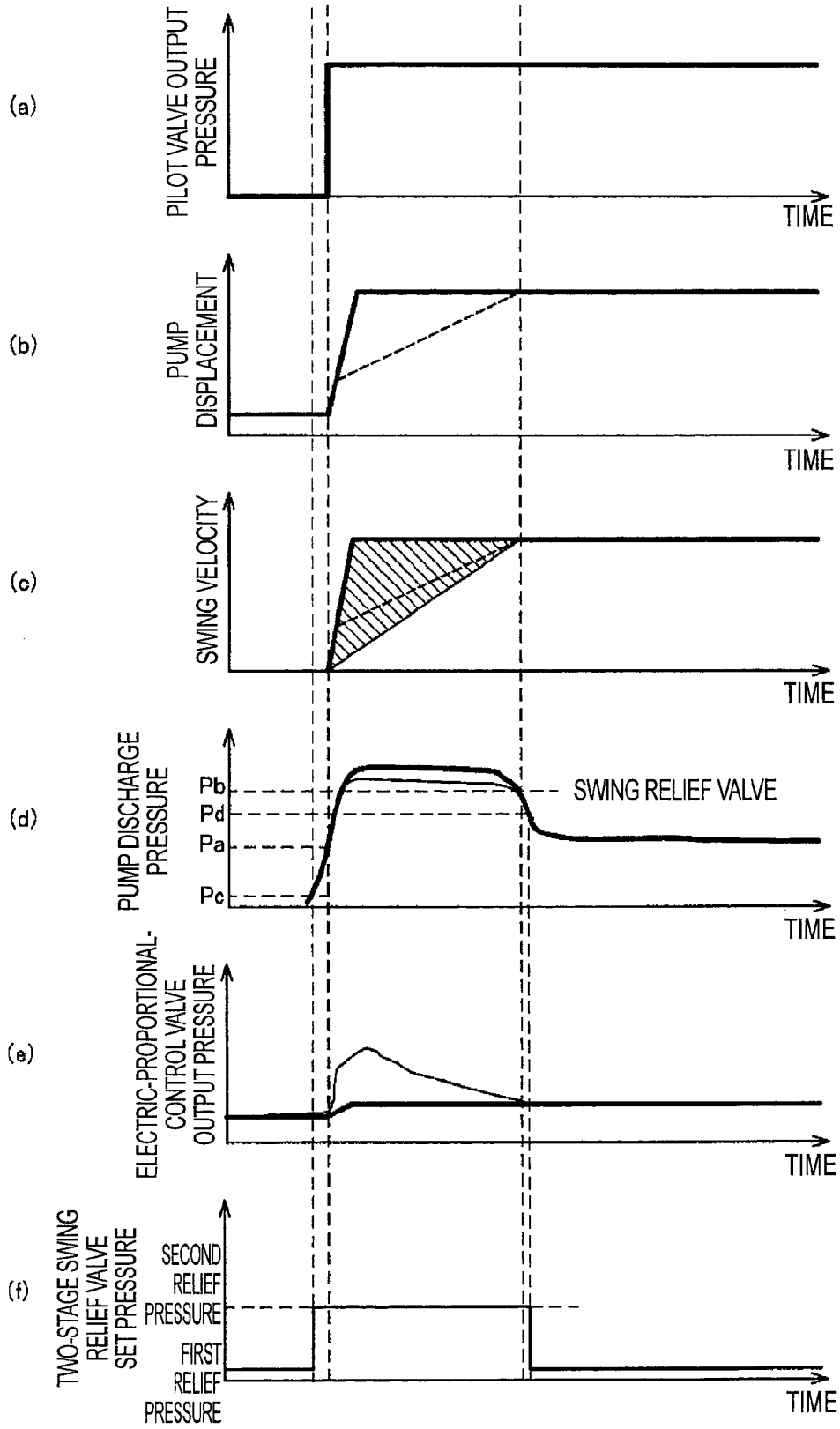
FIG. 3 is a group of graphs for explaining a swing cutoff (embodiment).

In the invention, whether the pump discharge pressure P exceeds the first set value Pa (see FIG. 3(*d*)) that is determined in advance by an experiment and the like when the swing velocity of the upper structure 5 is increasing (i.e. increasing the pump discharge pressure) while operating the control lever 18*a* for switching the swing control valve 13*a* of the hydraulic swing motor is set as a condition. When the above condition is satisfied, the target pump displacement to which the pump displacement D of the hydraulic pump 6 is controlled in accordance with the pump discharge pressure P can be reduced by an adjuster 37 provided in the controller 7.

When the pump discharge pressure P starts declining and falls below a second set value Pb (see FIG. 3(*d*)) that is set in advance by an experiment and the like, the adjustment by the adjuster 37 is canceled by the canceller 38 provided in the controller 7.

With the above arrangement, a pressure represented by a predetermined pressure pattern shown in FIG. 3(*e*) can be applied from the electric proportional pressure control valve 11 to the torque control valve 10 from the time when the pump discharge pressure P exceeds the first set value Pa to the time when the pump discharge pressure P falls below the second set value Pb as shown in FIG. 3(*d*). FIG. 3 will be described below.

At this time, the first set value Pa and the second set value Pb satisfy the relationship of Pa<Pb. When the swing is started, since the flow entering the hydraulic swing motor 12*a* is less than the discharge flow of the hydraulic pump 6, the pump discharge pressure is rapidly increased. If an operation for reducing the pump displacement (i.e. swing cutoff operation) is conducted after the pump discharge pressure exceeds the relief pressure, it takes time before the pump displacement is actually reduced. Accordingly, the first set value Pa is set considering the response time for reducing the pump displacement.

Further, when the operation for reducing the pump displacement by the swing cutoff operation is continued after the swing relief valve goes out of a relief condition (i.e. after the pump discharge pressure falls below the relief pressure), the flow entering the hydraulic swing motor 12*a* is reduced, so that the swing velocity of the upper structure may be lowered or the swing velocity may be fluctuated.

Accordingly, the second set value Pb has to be set around a pressure at which the swing relief valve goes out of the relief condition. Thus, the second set pressure Pb has to be set greater than the first set pressure Pa.

In the swing cutoff operation according to the invention, when the above condition is satisfied, the pump absorption horse power of the hydraulic pump 6 is restricted from the normal pump absorption horse power L1 to the pump absorption horse power L2 and the pump absorption horse power L2 is gradually restored to the pump absorption horse power L1.

Accordingly, when the swing of the upper structure 5 is started, the pump displacement D of the hydraulic pump 6 is controlled to be set at the pump absorption horse power L2. In other words, the pump absorption torque of the torque control valve 10 can be reduced, so that the pump displacement D of the hydraulic pump 6 can be controllably reduced. Thus, since the discharge flow from the hydraulic pump 6 is reduced, the relief flow discharged from the two-stage swing relief valve 14 can be reduced.

In accordance with the acceleration of the upper structure 5, the pump absorption horse power is gradually increased from the pump absorption horse power L2 to the pump absorption horse power L1. In other words, the reduced pump absorption torque of the torque control valve 10 is increased to the original pump absorption torque. Thus, when the upper structure 5 is at the steady swing state, all of the pump discharge amount can be supplied to the hydraulic swing motor 12*a*.

The pump absorption horse power L1 may be restricted to or restored from the pump absorption horse power L2 according to a detection signal from the pressure sensor 25 for detecting the pump discharge pressure P of the hydraulic pump 6 or a pressure sensor (not shown: since normal rotation and reverse rotation of the hydraulic swing motor 12*a* have to be detected, the pressure sensor is preferably provided at two locations) for detecting the pump discharge pressure P inputted to the hydraulic swing motor 12*a*.

The above arrangement of the invention enables the drive of the hydraulic pump 6 under the pump absorption horse power L2 (restricted by the adjuster to be low as a pump absorption torque for controlling the hydraulic pump) lower than the pump absorption horse power L1 (preset pump absorption torque value) without conducting the operation of the invention when the pump discharge pressure exceeds the first set value Pa during the acceleration of the swing velocity of the upper structure 5.

When the pump discharge pressure falls below the second set value Pb, the pump absorption horse power can be restored to the pump absorption horse power L1 without conducting the swing cutoff operation of the invention.

On the other hand, when the pump discharge pressure exceeds the first set value Pa during the acceleration of the swing velocity of the upper structure 5, the pump absorption horse power can be restricted to the low-pressure-side pump absorption horse power L2. Thus, the relief flow discharged without being used for driving the hydraulic swing motor 12*a* can be significantly reduced.

Further, when the pump discharge pressure falls below the second set value Pb, the pump absorption horse power can be increased from the pump absorption horse power L2 to the pump absorption horse power L1. Thus, when the upper structure 5 reaches the steady swing velocity, all of the pump discharge flow discharged from the hydraulic pump 6 can be supplied to the hydraulic swing motor 12*a* while the relief flow is reduced.

Incidentally, when the means for controlling the pump absorption torque is provided by the torque control valve, the adjuster 37 and the canceller 38 may be provided by a electric proportional pressure control valve and the like for controlling the torque control valve.

In FIG. 2, a vertical dimension Q1 of the pump absorption horse power L1 represents the relief flow discharged from the two-stage swing relief valve 14 without conducting the swing cutoff operation. Further, a vertical dimension Q2 of the pump absorption horse power L1 represents the relief flow discharged from the two-stage swing relief valve 14 after conducting the swing cutoff operation.

Alternatively, the swing velocity of the upper structure 5 may be detected by a speed detector (not shown). Then, the restriction from the pump absorption horse power L1 to the pump absorption horse power L2 or restoration from the pump absorption horse power L2 to the pump absorption horse power L1 may be effected in accordance with the detection signal from the speed detector.

Further alternatively, the operation amount of the control lever 18*a* of the pilot operation valve 18 may be detected by a pressure sensor 31 for detecting a pilot pressure of the control valve 18 or an angle sensor (not shown) for detecting an operation angle of the control lever 18*a* so that the pump absorption horse power is restricted from the pump absorption horse power L1 to the pump absorption horse power L2 or is restored from the pump absorption horse power L2 to the pump absorption horse power L1 in accordance with the detection signal of the pressure sensor 31 or the angle sensor. Further, the above-described detection sensor, detector, differential pressure sensor and angle sensor may be used in combination instead of being separately used.

The swing cutoff operation of the invention will be further described with reference to FIG. 3. Horizontal axes of FIG. 3 represent time axes common to FIGS. 3(*a*) to 3(*f*). The interval between the two dashed lines parallel to the vertical axis represents a period in which the swing velocity of the upper structure 5 is increased from the halted state to the steady swing velocity.

The vertical axis of FIG. 3(*a*) represents an output pressure of the pilot operation valve 18 detected by the pressure sensor 26. The output pressure of the pilot operation valve 18 can be detected as the operation amount of the control lever 18*a*.

The vertical axis in FIG. 3(*b*) represents the pump displacement D of the hydraulic pump 6. In FIG. 3(*b*), the bold line represents the pump displacement D when the swing cutoff of the invention is not conducted and the dotted line represents the pump displacement D when the swing cutoff operation of the invention is conducted.

The vertical axis in FIG. 3(*c*) represents a swing velocity V of the upper structure 5. The swing velocity V may be considered as the rate of flow entering into the hydraulic swing motor 12*a*. Accordingly, the vertical axis of FIG. 3(*c*) also represents the rate of flow entering into the hydraulic swing motor 12*a*. Thus, the bold line in FIG. 3(*c*) represents the discharge flow from the hydraulic pump 6 when the swing cutoff operation of the invention is not conducted.

Further, the dotted line represents the discharge flow from the hydraulic pump 6 when the swing cutoff operation of the invention is conducted. Further, the thin line represents a flow rate required for driving the upper structure 5 by the hydraulic swing motor 12*a* both in an instance in which the swing cutoff operation of the invention is conducted and an instance in which the swing cutoff operation of the invention is not conducted. In other words, irrespective of the amount of the pump discharge flow from the hydraulic pump 6, only the flow represented by the thin line is used for driving the hydraulic swing motor 12*a*.

The vertical axis in FIG. 3(*d*) represents the pump discharge pressure from the hydraulic pump 6. In FIG. 3(*d*), the bold line represents the pump discharge pressure P when the swing cutoff operation is not conducted or a swing relief valve with good override characteristics is used. The dotted line represents the pump discharge pressure P when a swing relief valve with poor override characteristics is used. Pa in the vertical axis represents the first set value and Pb represents the second set value.

The vertical axis in FIG. 3(*e*) represents a pilot output pressure outputted from the electric proportional pressure control valve 11. In FIG. 3(*e*), the bold line represents the pump output pressure outputted by the electric proportional pressure control valve 11 when the swing cutoff of the invention is not conducted and the dotted line represents the pump output pressure outputted by the electric proportional pressure control valve 11 when the swing cutoff operation of the invention is conducted.

The vertical axis in FIG. 3(*f*) represents the set pressure of a two-stage swing relief valve when the swing two-stage swing relief valve is used as the swing relief valve as described later.

Next, an instance when it is detected that the pilot operation valve 18 is in full operation by the pressure sensor 26 in FIG. 3(*a*) will be described below with reference to FIG. 1, FIG. 3 and FIG. 4 that shows a control flowchart of the swing cutoff.

Figure 4:
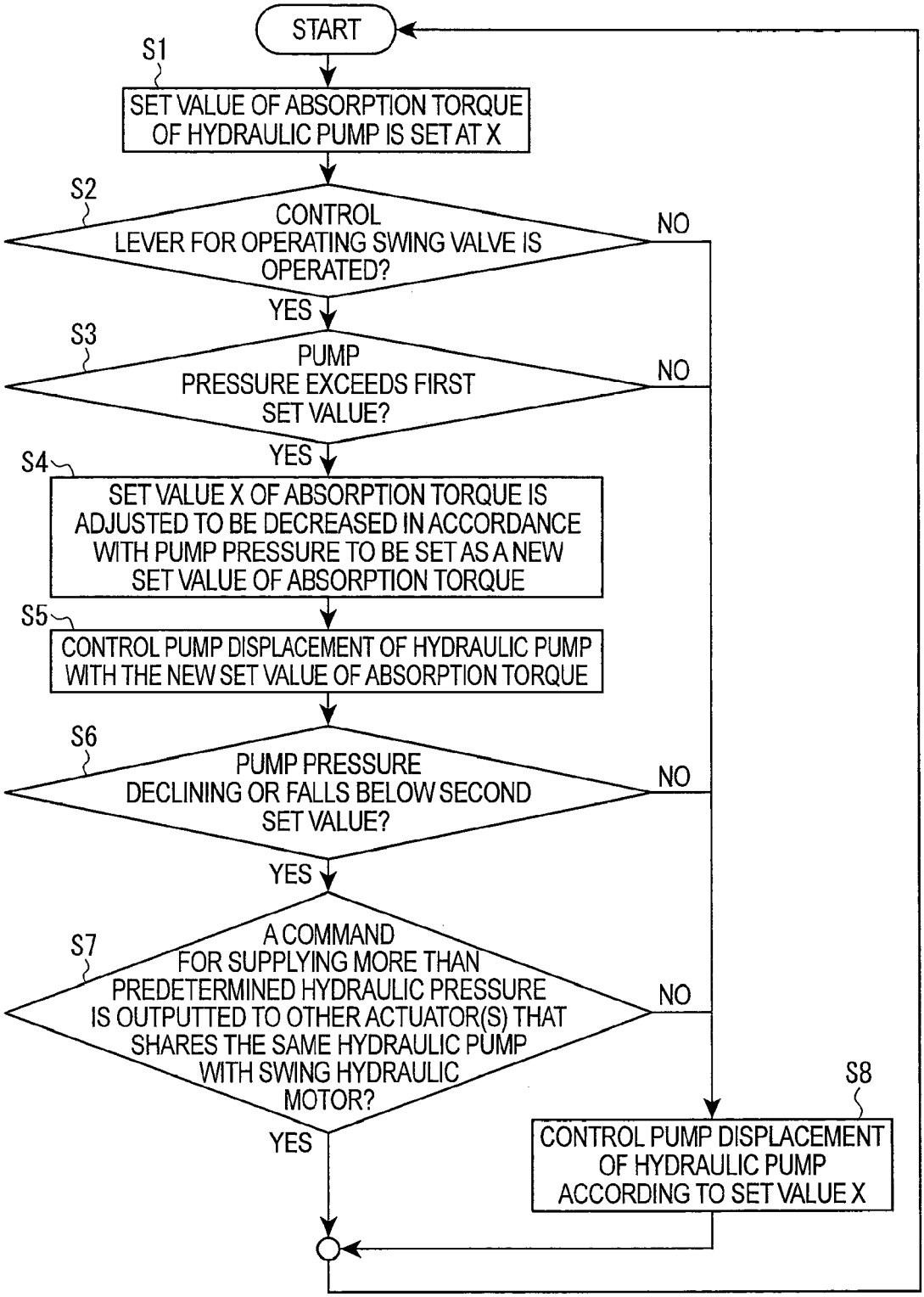
FIG. 4 is a control flowchart of the swing cutoff (embodiment).

In step S1 in FIG. 4, X is set as a set value for the pump absorption torque T of the hydraulic pump 6. In other words, an output pressure outputted by the electric proportional pressure control valve 11 shown in the bold line in FIG. 3(*e*) is set. After setting the set value X of the pump absorption torque T, the process advances to step S2.

In step S2, it is judged whether the pilot pressure for operating the swing control valve 13*a* is outputted from the pilot operation valve 18 or not. The operation on the pilot operation valve 18 can be judged by detecting the pilot output pressure shown in FIG. 3(*a*) by the pressure sensor 26.

When it is judged that the pilot operation valve 18 is operated in step S2, the process advances to step S3. Otherwise, the process advances to step S8, in which the same operation as that when the swing cutoff operation is not conducted.

In step S3, whether the pump pressure P exceeds the first set pressure Pa that is set in advance by an experiment and the like or not is judged. When the pressure exceeds the set pressure, the process advances to step S4. Otherwise, the process advances to step S8, in which the same operation as that when the swing cutoff operation is not conducted.

In step S4, the set value X of the pump absorption torque is adjusted by the adjuster 37 provided in the controller 7 in accordance with the pump pressure P so that the pump absorption torque of the hydraulic pump 6 is set at a new value of the pump absorption torque for lowering the pump absorption torque in the hydraulic pump 6. When the new set value for the pump absorption torque is set in step S4, the process advances to step S5.

In step S5, the pump displacement D of hydraulic pump 6 is controlled in accordance with the new set value of the pump absorption torque. Specifically, the controller 7 controls the electric proportional pressure control valve 11 so that the pilot output pressure shown in the dotted line in FIG. 3(*e*) is outputted to the torque control valve 10. Accordingly, the torque control valve 10 controls the pump displacement of the hydraulic pump 6 in accordance with the new set value of the pump absorption torque.

Incidentally, when the swing cutoff operation is not conducted, the controller 7 controls so that the output pressure shown in the bold line FIG. 3(*e*) is outputted from the electric proportional pressure control valve 11 to the torque control valve 10. According to the state represented by the bold line, the pump displacement D of the hydraulic pump 6 is controlled in accordance with the set value X of the pump absorption torque T.

In step S5, when the control of the pump displacement D of the hydraulic pump 6 is started in accordance with the new set value of the pump absorption torque, the process advances to the step S6. In step S6, whether the pump pressure P is declining or not or whether the pump pressure P falls below the second set value Pb or not is judged. Specifically, when the pump pressure P is declining and falls below the second set value Pb, the process advances to step S8, in which the adjustment by the adjuster 37 is canceled by the canceller 38.

In other words, the set value of the pump absorption torque T is restored to the original set value X of the pump absorption torque by the canceller 38. This process will be described below with reference to FIGS. 1 and 3. When the output pressure from the electric proportional pressure control valve 11 is received by the torque control valve 10, the torque control valve 10 is switched to the position II in FIG. 1 by the adjuster 37, so that the pump absorption torque T of the hydraulic pump 6 is lowered to reduce the pump displacement D of the hydraulic pump 6.

As a result of the above operation, the pump displacement D of the hydraulic pump 6 is changed to the pump displacement shown in the dotted line in FIG. 3(*b*). Then, the pump displacement D gradually increases as shown in the dotted line in FIG. 3(*b*) until the upper structure 5 reaches to the steady swing velocity from the halted state.

Incidentally, though an example in which the pump displacement D of the hydraulic pump 6 is started from a minimum pump displacement is shown in FIG. 3(*b*), a hydraulic pump in which the minimum pump displacement can be set at zero displacement may alternatively used. In this case, the pump displacement D of the hydraulic pump 6 increases from zero instead of the minimum pump displacement as shown in FIG. 3(*b*).

Since the pilot operation valve 18 is in full operation, the pump discharge flow discharged from the hydraulic pump 6 is supplied toward the hydraulic swing motor 12*a* as shown in the dotted line in FIG. 3(*c*). When the pump discharge pressure P falls below the second set value Pb as shown in FIG. 3(*d*), the controller 7 controls the canceller 38 to cancel the adjustment so that the set value of the pump absorption torque adjusted by the adjuster 37 is restored to the original set value X. Then, the pump displacement D of the hydraulic pump 6 is returned to a state in which the swing cutoff is not conducted.

Incidentally, when the swing cutoff operation is not conducted, the flow represented by the bold line in FIG. 3(*c*) among the discharge flow discharged from the hydraulic pump 6 is supplied to the hydraulic swing motor 12*a*.

Specifically, the flow consumed by the hydraulic swing motor 12*a* that swings the upper structure 5 from the time at which the swing of the upper structure 5 is started to the time at which the upper structure 5 reaches to the steady swing velocity is represented by the thin line. The flow consumed by the hydraulic swing motor 12*a* does not vary irrespective of the presence of the swing cutoff operation.

Accordingly, when the swing cutoff operation is not conducted, the flow corresponding to the difference between the bold line and the thin line is discharged from the two-stage swing relief valve 14 without being consumed by the drive of the hydraulic swing motor 12*a*. The total of the relief flow discharged from the two-stage swing relief valve 14 can be represented by the area surrounded by the bold line and the thin line.

In contrast, when the swing cutoff operation of the invention is conducted, since the pump displacement D of the hydraulic pump 6 is controlled while being adjusted by the adjuster 37, the inclination of the increase in the pump displacement D of the hydraulic pump 6 is moderate as shown in FIG. 3(*b*). Accordingly, the pump displacement D moderately increases as shown in the dotted line without rapidly increasing as shown in the bold line.

Here, even when the swing cutoff operation is conducted, the flow represented by the dotted line in FIG. 3(*c*) is supplied to the hydraulic swing motor 12*a*. The relief flow discharged from the two-stage swing relief valve 14 without being consumed by the hydraulic swing motor 12*a* corresponds to the difference between the dotted line and the thin line. Further, the total of the relief flow discharged from the two-stage swing relief valve 14 can be represented by the area surrounded by the bold line and the thin line.

Thus, by conducting the swing cutoff operation, the relief flow discharged from the two-stage swing relief valve 14 can be reduced. Further, since the rate of the flow to be consumed by the hydraulic swing motor 12*a* can be secured when the relief flow is reduced, the upper structure 5 can be accelerated from the halted state to the steady swing velocity under the same condition as that in an instance in which the swing cutoff operation is not conducted.

Now back to FIG. 4, it is judged in step S7 whether a command for supplying more than predetermined amount of pressure oil is outputted to the other hydraulic actuator(s) 12 that shares the hydraulic pump 6 with the hydraulic swing motor 12*a*. If the swing cutoff operation is conducted when the command for supplying more than predetermined amount of pressure oil to the other hydraulic actuator(s) 12 that shares the hydraulic pump with the hydraulic swing motor 12*a* is outputted, the flow supplied by the hydraulic pump 6 runs short. However, the judgment in step S7 prevents the occurrence of any accompanying problem.

When it is judged in step S7 that a command for supplying more than predetermined amount of pressure oil is outputted to the other hydraulic actuator(s) 12 that shares the hydraulic pump 6 with the hydraulic swing motor 12*a*, the process advances to step S8 in which the same operation as that without conducting the swing cutoff operation is conducted.

Thus, the hydraulic swing motor 12*a* can be controllably driven in the same manner as that without conducting the swing cutoff operation in the invention. Further, the relief flow discharged from the two-stage swing relief valve 14 can be reduced, thus considerably remedying the problems such as deterioration in engine fuel consumption, increase in hydraulic oil temperature and increase in relief noise.

Further, as shown in the dotted line in FIG. 3(*d*), when the two-stage swing relief valve 14 with poor override characteristics is used, the pump discharge pressure from the hydraulic pump 6 is decreased when the swing cutoff operation is conducted. Accordingly, the operation cutoff operation using the two-stage swing relief valve 14 with poor override characteristics will be described below.

Briefly speaking, the override characteristics means a relationship between an input pressure to a relief valve and the rate of relief flow discharged through the relief valve, which is sometimes used for explaining the characteristics of the relief valve. Ideally, a relief valve is constructed so that the relief valve hardly discharge a fluid under a certain relief pressure and does not vary an entrance side pressure thereof irrespective of an increase in the rate of the relief flow beyond the certain relief pressure. A relief valve that exhibits such characteristics is called a relief valve with good override characteristics.

Figure 6:
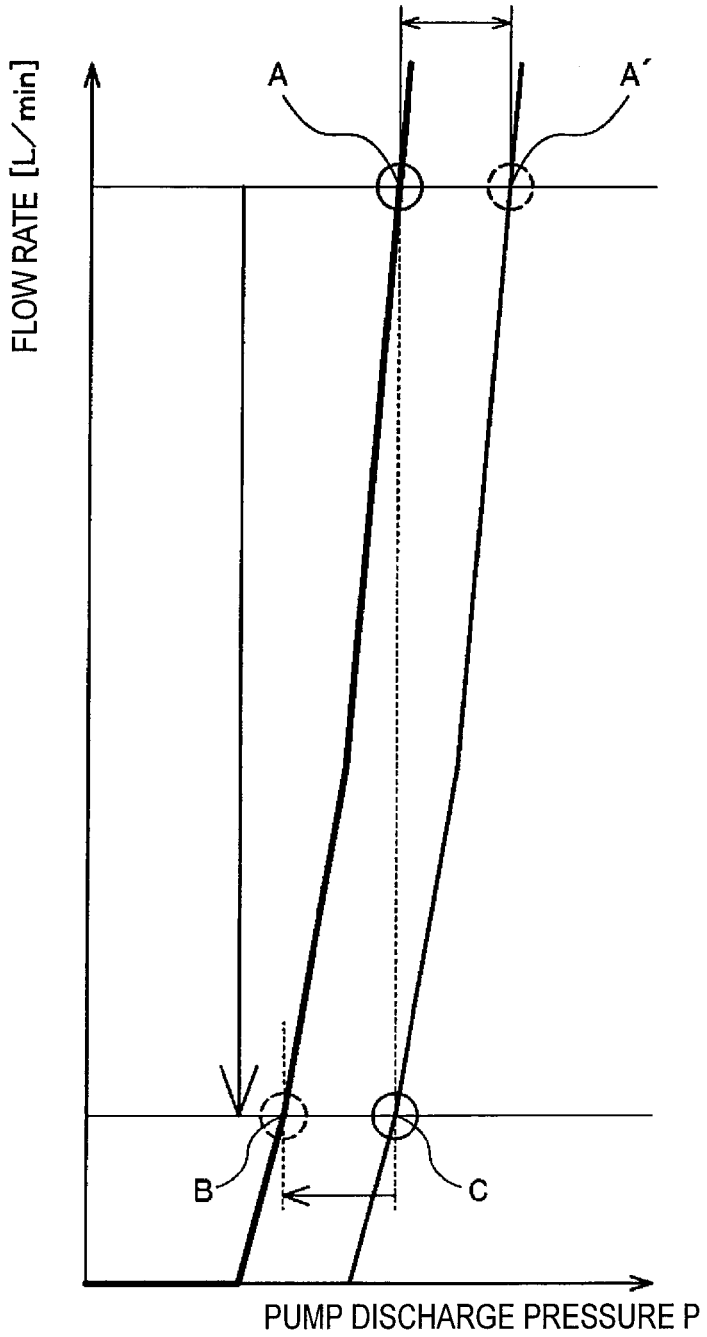
FIG. 6 is a graph showing override characteristic of the two-stage swing relief valve (embodiment).

In contrast, a relief valve with poor override characteristics is a relief valve that increases the relief pressure in accordance with the increase in the rate of the relief flow. FIG. 6 shows the characteristics of two relief valves with poor override characteristics, in which the horizontal axis represents an entrance-side pressure of the relief valve and the vertical axis represents the rate of the relief flow. Though not shown in FIG. 6, when a relief valve with good override characteristics is used, the characteristics are drawn as a graph extending substantially parallel to the vertical axis from the relief pressure.

In view of the noise during the relief operation, response speed, absolute flow rate and the like, a relief valve with poor override characteristics sometimes has to be used. Accordingly, description will be made below in an instance in which a relief valve with poor override characteristics is used as the two-stage swing relief valve 14 in the hydraulic device for an upper structure in which the swing cutoff operation is conducted.

Here, it is supposed that a relief valve with poor override characteristics shown by the bold line in FIG. 6 is used as the two-stage swing relief valve 14. At this time, it is supposed that the two-stage swing relief valve 14 having the characteristics shown by the bold line is designed to relieve the pressure at a point A. When the swing cutoff operation is conducted on the two-stage swing relief valve 14 having the characteristics shown by the bold line, since the pump discharge amount from the hydraulic pump 6 decreases, the flow rate supplied to the two-stage swing relief valve 14 having the characteristics shown by the bold line also decreases, so that the entrance-side pressure of the two-stage swing relief valve 14 having the characteristics shown by the bold line decreases to a point B.

As a result, as compared with the time at which the upper structure is driven by the relief pressure at the point A, the pressure of the oil supplied to the hydraulic swing motor 12*a*, i.e. the pump discharge pressure P at the entrance of the two-stage swing relief valve 14 is reduced to decrease the swing torque. Thus, the accelerating performance when the upper structure 5 is swung or a lateral-press force for laterally pressing the working equipment to an object by swinging the upper structure 5 is lowered.

In order to solve the above problems, even when a swing relief valve with poor override characteristics is used and the relief flow rate is reduced by conducting the swing cutoff, the invention is designed so that the relief pressure is not reduced in accordance with the reduction in the relief flow rate. Specifically, the two-stage swing relief valve 14 is provided by a two-stage swing relief valve of which relief pressure can be set to a second relief pressure that is higher than a first relief pressure.

Referring to FIG. 6, the relief pressure is set at a high-pressure side to shift the bold-line condition to the thin-line condition. Thus, the same pump discharge pressure P as that without conducting the swing cutoff or the pump discharge pressure P to the hydraulic swing motor 12*a* can be obtained.

The above, as well as the operation of the two-stage swing relief valve 14, will be described below with further reference to FIG. 6. In a normal operation, the relief pressure of the two-stage swing relief valve 14 is set at a low-pressure-side first relief pressure, so that the bold-line characteristics in FIG. 6 are exhibited. When the swing cutoff is conducted, the relief pressure of the two-stage swing relief valve 14 can be set at a high-pressure-side second relief pressure as shown in the thin line in FIG. 6.

Figure 5:
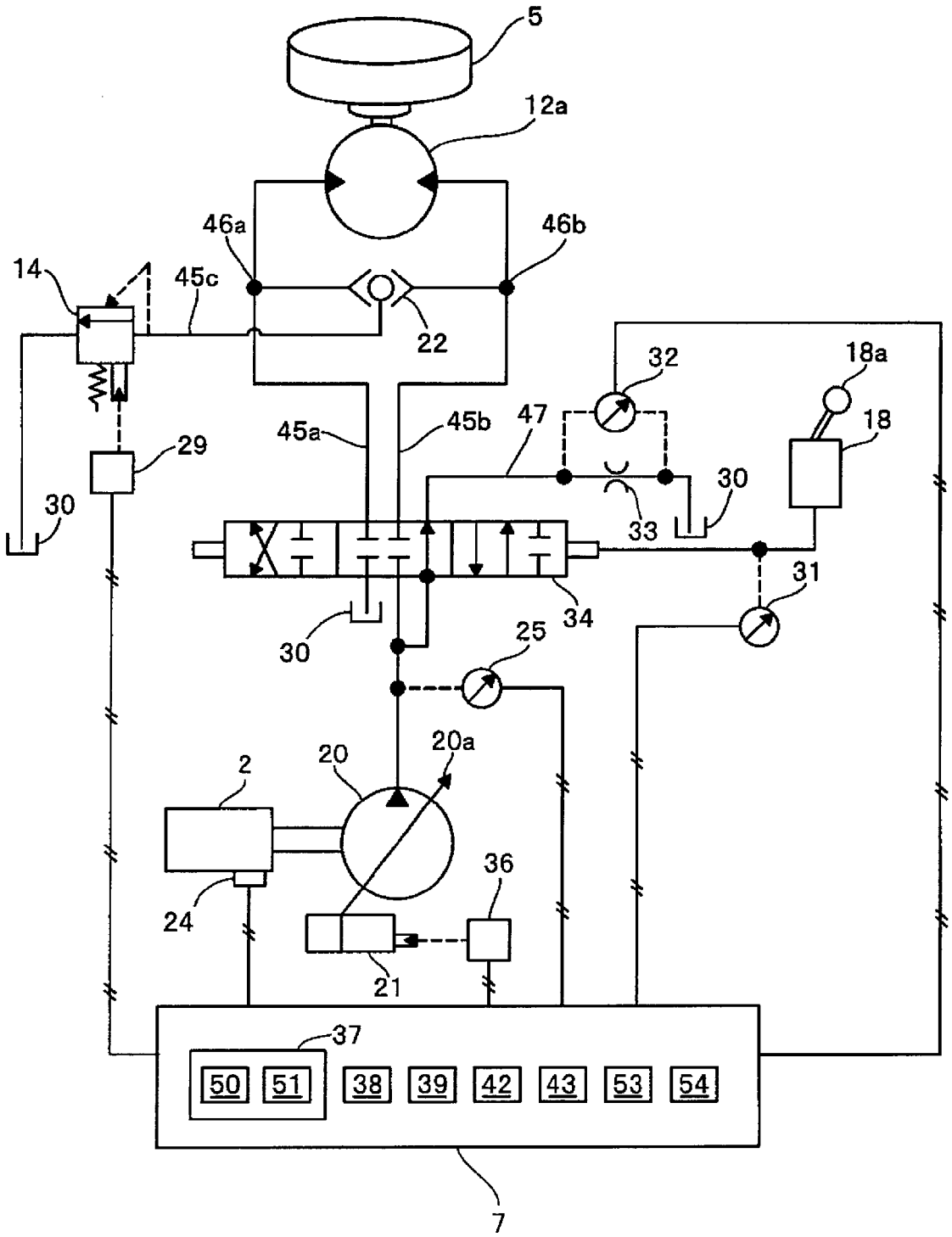
FIG. 5 is a hydraulic circuit diagram of a primary part using a two-stage swing relief valve (embodiment).

In order to change the set pressure of the two-stage swing relief valve 14, a solenoid switch 29 for controlling the two-stage swing relief valve 14 is provided as shown in FIG. 5. As shown in FIG. 5, a swing relief pressure switch 39 provided in the controller 7 is adapted to set the relief pressure at the second relief pressure (high-pressure side) and the first relief pressure (low-pressure side) by switching the two-stage swing relief valve 14 by controlling the solenoid switch 29.

The solenoid switch is provided by, for instance, an on/off solenoid valve, which may be directly attached or externally connected to the two-stage swing relief valve. FIG. 5 shows an instance in which the solenoid switch 29 is on and the two-stage swing relief valve 14 is set at the second relief pressure. When the solenoid switch 29 is off, the relief pressure can be set at the first relief pressure.

The arrangement shown in FIG. 5 is a part of the arrangement shown in FIG. 1 that shows the hydraulic device for swinging the upper structure 5. The same components as those in FIG. 1 are denoted by the same reference signs. Since the same reference signs as those in FIG. 1 is used, the description on the components in FIG. 5 is omitted.

The variable displacement hydraulic pump in FIG. 5 is exemplified by an electrically controlled pump 20 in which the pump displacement is directly commanded by the controller 7. The pump displacement or the pump 20 can be controlled by a swash plate control valve 21 controlled by a solenoid valve 36.

Incidentally, the hydraulic pump in FIG. 5 may be arranged so that the swash plate control valve 21 is controlled by a pilot pressure. With the above arrangement, the same operation as the hydraulic pump 6 shown in FIG. 1 can be conducted.

Figure 12:
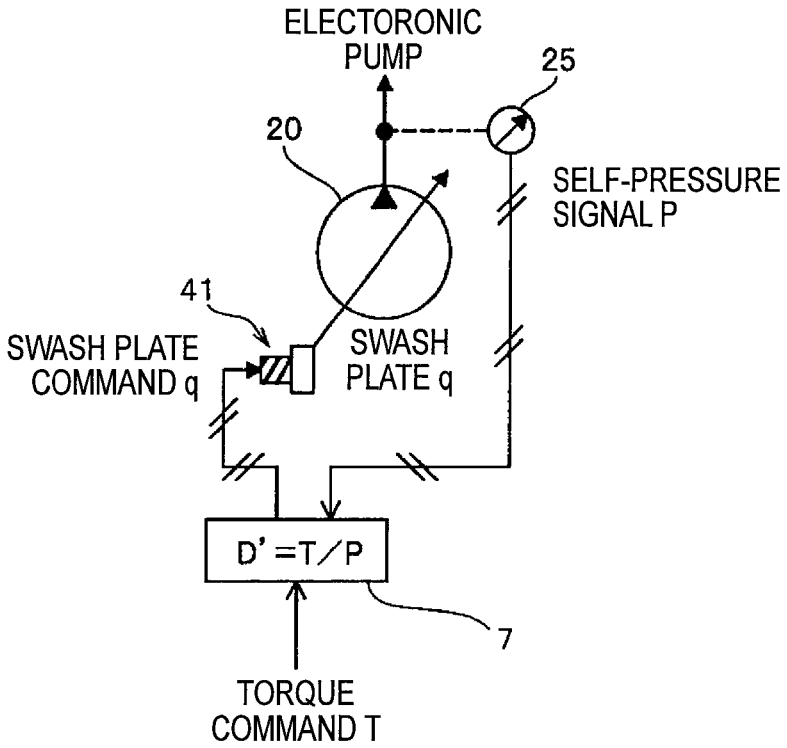
FIG. 12 is a diagram showing a pump displacement control of an electronic pump (embodiment).
Figure 13:
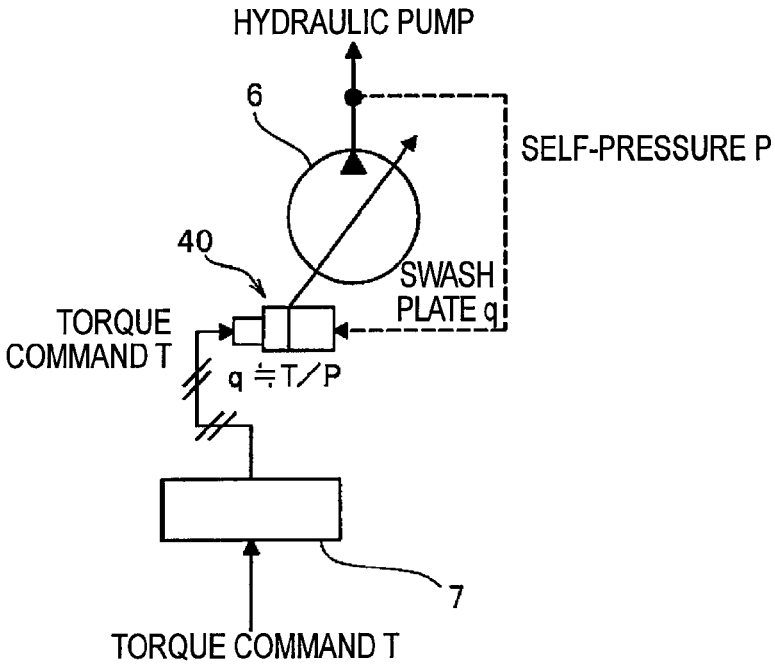
FIG. 13 is a diagram showing a pump displacement control of a hydraulic pump (embodiment).

Specifically, the primary part for controlling the pump displacement of the hydraulic pumps 6, 20 may be designed as shown in FIG. 12 (the hydraulic pump 20) and FIG. 13 (the hydraulic pump 6).

As shown in FIG. 12, discharge pressure from the pump 20 is detected by the pressure sensor 25. Then, the controller 7 obtains the target pump displacement for controlling the pump displacement of the pump 20 using the relational expression D=T/P based on the pump discharge pressure P detected by the pressure sensor 25 and the torque command value T. Alternatively, the target pump displacement for controlling the pump displacement of the pump 20 may be obtained by a detection signal of the operation amount of the control lever 18*a* or, in a open-center hydraulic circuit, a detection signal corresponding to the operation amount of the control lever 18*a* detected by a differential pressure sensor 32.

The controller 7 controls the pump absorption torque using the target pump displacement calculated by the above relational expression or controls the pump displacement of the pump 20 by outputting the target pump displacement to a swash plate control valve 41 as a swash-plate command.

In a hydraulic pump 6 shown in FIG. 1, the pump discharge pressure P from the hydraulic pump 6 is inputted to a swash plate control valve 40. Then, the controller 7 outputs a control command based on the torque command T to the swash plate control valve 40 to control the swash plate control valve 40 and, consequently, the pump displacement of the hydraulic pump 6.

Description on an arrangement will be made below, in which the set pressure of the two-stage swing relief valve 14 having the bold-line characteristics is set as the relief pressure at the point A in FIG. 6 in a normal operation in which the swing cutoff is not conducted when the upper structure 5 is swung. In the above arrangement, when the relief pressure of the two-stage swing relief valve 14 is not changed to the high-pressure side, the entrance-side pressure of the two-stage swing relief valve 14 having the bold-line characteristics is lowered by conducting the swing cutoff. Then, the rate of the relief flow from the two-stage swing relief valve 14 having the bold-line characteristics is decreased to, for instance, a range indicated by the point B. The pump discharge pressure P applied on the hydraulic swing motor 12*a* is the pressure at the point B.

Accordingly, it is considered that the same flow rate as the relief flow rate at the point B may be relieved from the two-stage swing relief valve 14 when the swing cutoff is conducted. At this time, by changing the relief pressure of the two-stage swing relief valve 14 to the high-pressure side so that the pressure at the entrance of the two-stage swing relief valve 14 becomes equal to the relief pressure at the point A (i.e. by shifting the pressure from the bold line to the thin line in FIG. 6), the pump discharge pressure P applied on the hydraulic swing motor 12*a* can be changed to the pump discharge pressure P at a point C without changing the relief flow rate discharged from the two-stage swing relief valve 14, thus requiring no reduction in the pump discharge pressure P applied on the hydraulic swing motor 12*a*.

Accordingly, as shown in FIG. 5, the relief pressure of the two-stage swing relief valve 14 can be set in two stages in the invention when the swing cutoff is conducted. In other words, when the swing cutoff is conducted, the relief pressure of the two-stage swing relief valve 14 can be set at the high-pressure-side second relief pressure by controlling the solenoid switch 29 shown FIG. 5.

When the relief pressure of the two-stage swing relief valve 14 is set at the high-pressure-side second relief pressure, the two-stage swing relief valve 14 having the characteristics represented by the thin line in FIG. 6 can be provided. At this time, the relief pressure of the two-stage swing relief valve 14 having the thin-line characteristics can be increased to the pressure at a point A' that is shifted rightward from the position A. Even when the swing cutoff is conducted and the entrance-side pressure of the two-stage swing relief valve 14 having the thin-line characteristics is reduced, the entrance-side pressure of the two-stage swing relief valve 14 having the thin-line characteristics can be set at a pressure equal to that at the point A in spite of the fact that the relief flow rate discharged from the two-stage swing relief valve 14 having the thin-line characteristics becomes the same as the relief flow rate at the point B.

With the above arrangement, the relief pressure is not decreased (the pressure at the point A=the pressure at the point C) even when the relief flow is reduced by the swing cutoff. In other words, the reduction in the pump discharge pressure P applied on the hydraulic swing motor 12*a* is not necessary.

Figure 14:
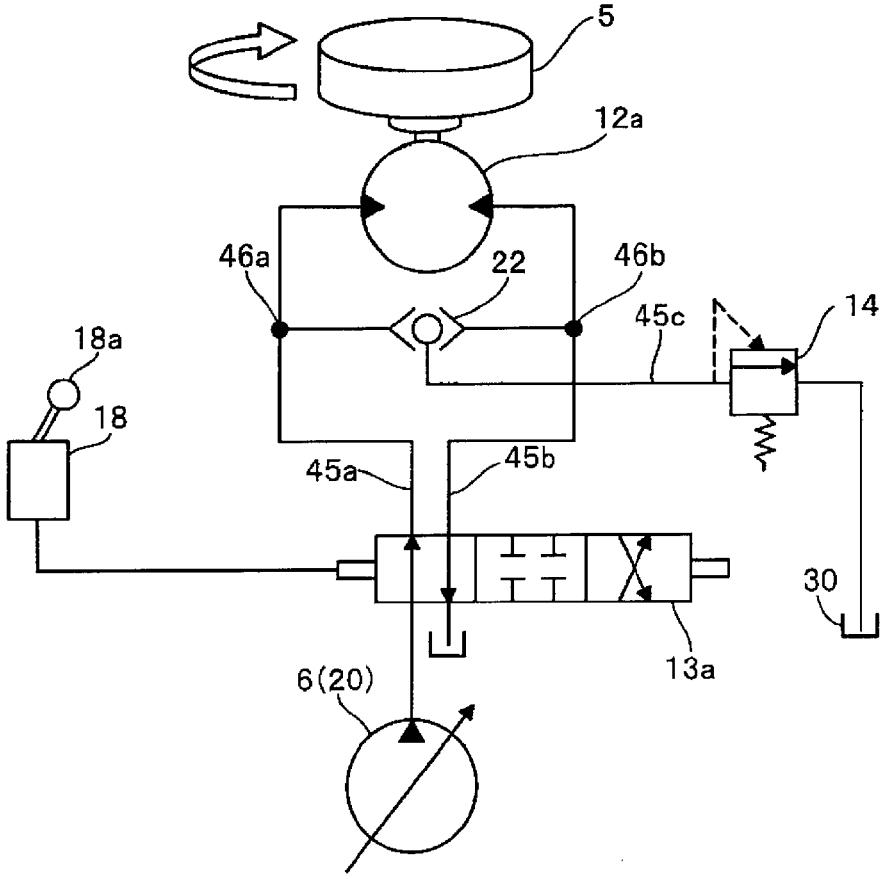
FIG. 14 is a circuit diagram of a primary part showing a drive condition of an upper structure (embodiment).

Incidentally, when the swing of the upper structure 5 starts to be accelerated, the flow of the pump pressure oil discharged from the hydraulic pump 6 or the pump 20 is supplied from an oil path 45*a* to the hydraulic swing motor 12*a* through the swing control valve 13*a*, thereby swinging the upper structure 5 clockwise in FIG. 14. When the increasing pump discharge pressure P exceeds a third set pressure Pc as shown in FIGS. 3(*d*) and 3(*f*), the relief pressure of the two-stage swing relief valve 14 shown in FIG. 14 is set at the high-pressure-side second relief pressure.

By setting the relief pressure of the two-stage swing relief valve 14 at the second relief pressure, the hydraulic pressure of the discharge flow supplied to the hydraulic swing motor 12*a* can be set at the second relief pressure, thereby causing the swing and acceleration of the upper structure 5. Incidentally, an oil path 47 shown in FIG. 5 is omitted in FIGS. 14 and 15. Accordingly, the swing control valve 13*a* is illustrated as a four-port switching valve.

Incidentally, the flow of the pressure oil discharged from the hydraulic swing motor 12*a* is discharged through an oil path 45*b* and the swing control valve 13*a* to the reservoir 30. The flow of the pressure oil discharged from a branch point 46*a* to an oil path 45*c* through a check valve 22 is controlled by the relief pressure of the two-stage swing relief valve 14.

Figure 7:
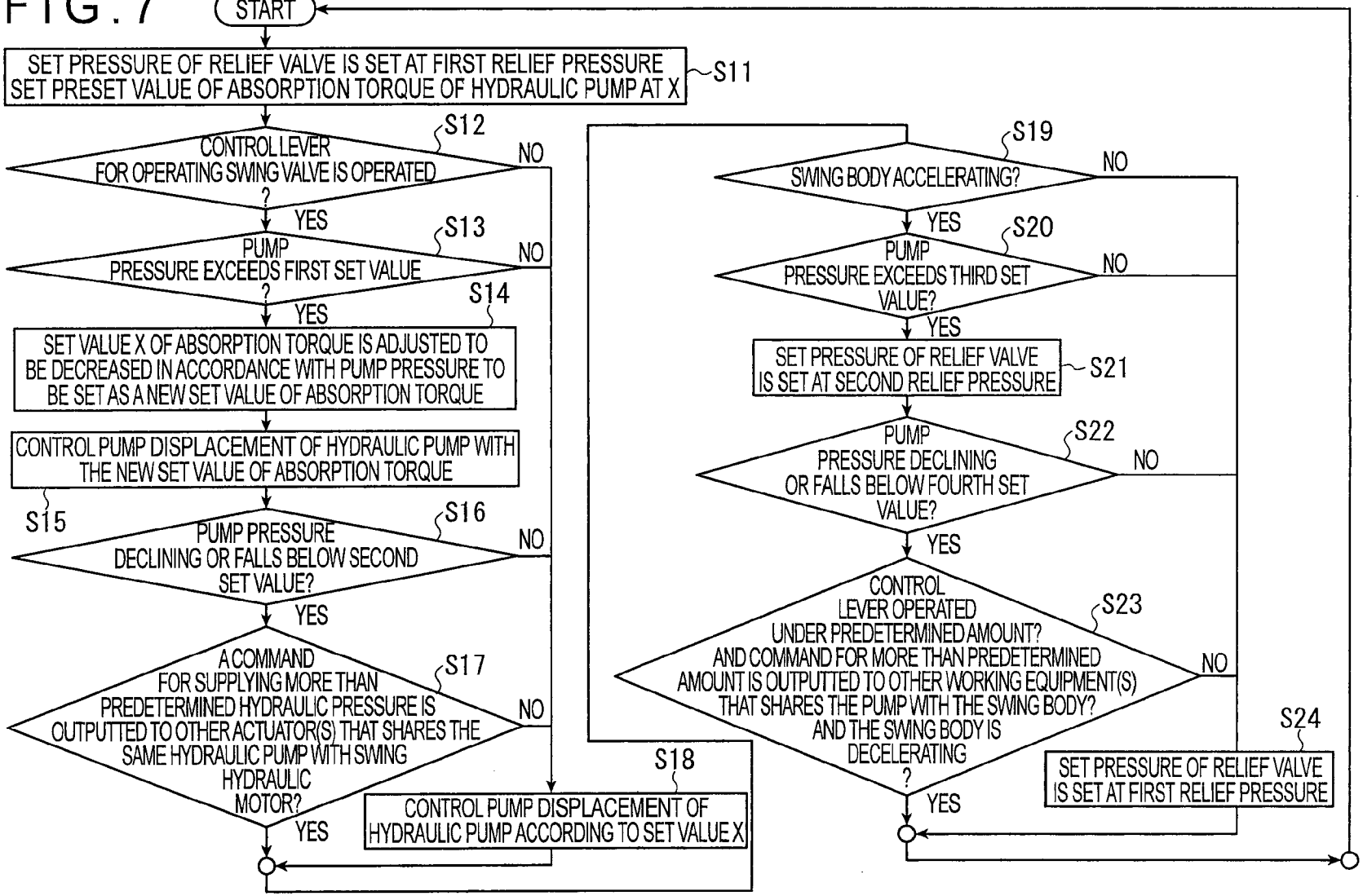
FIG. 7 is a control flowchart using the two-stage swing relief valve (embodiment).

Next, the swing cutoff operation using the two-stage swing relief valve 14 will be described below with reference to the flowchart of FIG. 7.

In step S11, the set pressure of the two-stage swing relief valve 14 is set at the low-pressure-side first relief pressure and the set value of the pump absorption torque of the hydraulic pump 6 is set at X. Then, the process advances to step S12. However, the processes in steps S12 to S18 represent the swing cutoff operation, which are the same as in steps S2 to S8 in FIG. 4 and will not be further described.

The processes in steps S19 to S24 represent a control flow of the two-stage swing relief valve 14.

In step S19, whether the swing body is accelerating or not is judged by a determining unit 54. The determining unit 54 recognizes that the pump discharge pressure is increasing when the operation amount of the control lever 18 is greater than a predetermined amount D. When it is judged "Yes" in step S19, the process advances to step S20. When it is judged "No" in step S19, the process advances to step S24 to set the relief pressure of the two-stage swing relief valve 14 at the first relief pressure.

In step S20, whether the pump discharge pressure P exceeds a third set value Pc or not is judged. When it is judged "Yes" in step S20, the process advances to step S21. When it is judged "No" in step S20, the process advances to step S24 and returns to step S11 while keeping the set pressure of the two-stage swing relief valve 14 at the first relief pressure and the process from step 12 are repeated.

Figure 8:
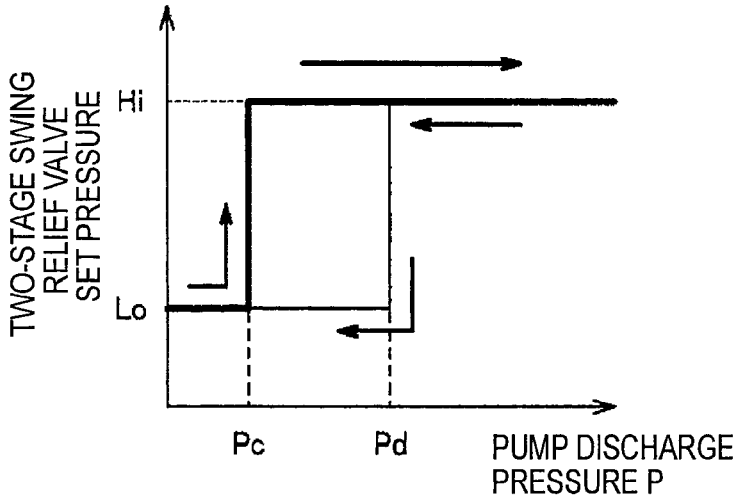
FIG. 8 is a graph showing a relationship between a relief pressure and a pump discharge pressure of the swing relief valve (embodiment).

The third set value Pc of the pump discharge pressure P and the fourth set value Pd of the pump discharge pressure P indicated in step S21 will be described below with reference to FIG. 8. FIG. 8 is a graph showing the relief pressure of the two-stage swing relief valve 14 on the vertical axis and the pressure at the entrance of the hydraulic swing motor 12*a* (pump discharge pressure P) on the horizontal axis. This graph shows a relationship between the relief pressure (the high-pressure-side second relief pressure and the low-pressure-side first relief pressure, the second relief pressure>the first relief pressure) of the two-stage swing relief valve 14 and the pump discharge pressure (the third set value Pc and the fourth set value Pd, Pc>Pd).

When it is judged that the swing of the upper structure 5 is accelerating based on the operation on the swing lever 18*a* and the increase in the pump discharge pressure and the pump discharge pressure P exceeds the third set value Pc, the relief pressure of the two-stage swing relief valve 14 is switched from the low-pressure-side first relief pressure Lo to the high-pressure-side second relief pressure Hi. When the upper structure 5 reaches to the steady swing state and the pump discharge pressure falls below the fourth set value Pd, the relief pressure of the two-stage swing relief valve 14 is controllably decreased from the high-pressure-side second relief pressure Hi to the low-pressure-side first relief pressure Lo.

When the third set value Pc and the fourth set value Pd are set close with each other, there is a risk that the relief pressure of the two-stage swing relief valve 14 is frequently switched between the low-pressure-side first relief pressure and the high-pressure-side second relief pressure around the set pressure values. Accordingly, the third set value Pc and the fourth set value Pd can be obtained by an experiment so as to avoid the above problem.

The two-stage swing relief valve 14 is provided in order to protect a swing mechanism and the like from an excessive pump discharge pressure P. When the swing control valve 13*a* is closed and the pump discharge pressure P is not transferred from the hydraulic pump 6, the pump discharge pressure P is generated on the hydraulic swing motor 12*a* on, for instance, driving the upper structure 5 by an external force. Thus, also in such an instance, the two-stage swing relief valve 14 works for protecting a swing mechanism and the like from an excessive pump discharge pressure P.

Further description will be made below with reference back to FIG. 7. In step S21, a control signal is outputted from the controller 7 to the solenoid switch 29 to set the relief pressure of the two-stage swing relief valve 14 from the low-pressure-side first relief pressure to the high-pressure-side second relief pressure. When the relief pressure of the two-stage swing relief valve 14 is set at the high-pressure-side second relief pressure, the process advances to step S22.

In step S22, whether the pump pressure P is declining or not or whether the pump pressure P falls below the fourth set value Pd or not is judged. When it is judged "Yes", the process advances to step S23. When judged "No", the process advances to step S24. In step S24, the relief pressure of the two-stage swing relief valve 14 is changed to the low-pressure-side first relief pressure.

The third set value Pc is set at a value smaller than the first set value Pa. The fourth set value Pd is set at a value not larger than the second set value Pb. Accordingly, during the swing cutoff operation, the set value of the relief pressure of the two-stage swing relief valve 14 necessarily becomes high (the second relief pressure), so that no switching occurs between the first relief pressure and the second relief pressure. Thus, a pressure fluctuation caused on account of switching of the set values of the relief pressure during the swing cutoff can be avoided.

In step S23, a judgment is made on: whether the control lever 18*a* is not operated by the predetermined amount D or less; and whether a command for supplying predetermined or more amount of pressure oil is outputted to the other hydraulic actuator(s) 12 that shares the hydraulic pump 6 with the hydraulic swing motor 12*a*, and whether the upper structure 5 is not decelerating.

When the result of the judgment is "No", the process advances to step S24. When the result is "Yes", the process goes back to step S11 and the processes of the swing cutoff operation from step S12 and the control of the two-stage swing relief valve 14 from step S19 are repeated. Incidentally, how to judge whether the upper structure 5 is decelerating or not will be described below in detail with reference to FIG. 17.

In step S24, the set pressure of the two-stage swing relief valve 14 is controllably changed to the first relief pressure. When the control process in step S24 is ended, the process returns back to step S11 and the control process from step S12 is repeated. Accordingly, when both of the results of the judgments in steps S22 and S23 are "Yes", the set pressure of the two-stage swing relief valve 14 is kept at the second relief pressure.

Figure 9:
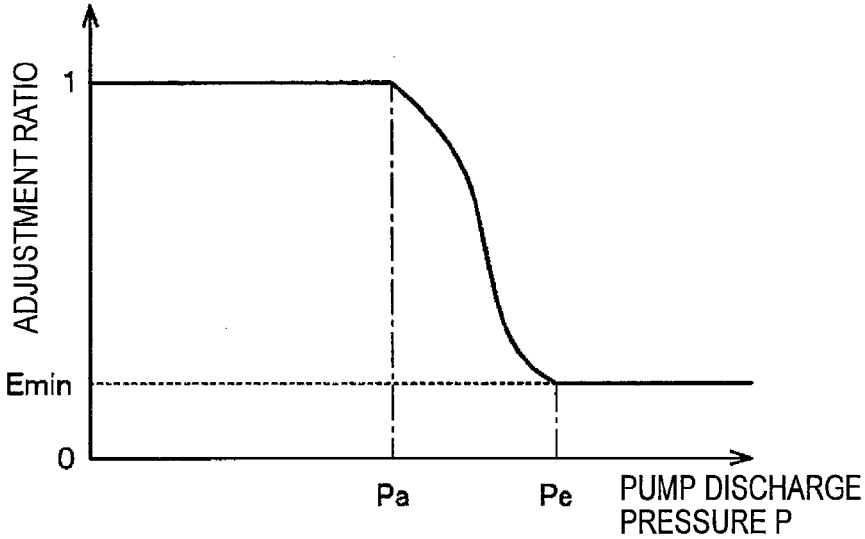
FIG. 9 is a graph showing characteristics of an adjustment-amount command value to a torque control valve (embodiment).

A process for decreasing (restricting) the pump absorption torque by the torque control valve 10 will be further described below with reference to FIGS. 9 to 11. FIG. 9 shows a relationship between the pump discharge pressure P and the adjustment amount to the torque control valve 10, in which the vertical axis represents a torque adjustment ratio of the pump absorption torque T and the horizontal axis represents the pump discharge pressure P. Until the pump discharge pressure P becomes the first set value Pa, the pump absorption torque is not restricted by the torque control valve 10. When the pump discharge pressure P reaches or exceeds the first set value Pa, the pump absorption torque is restricted to reduce the pump displacement.

Figure 10:
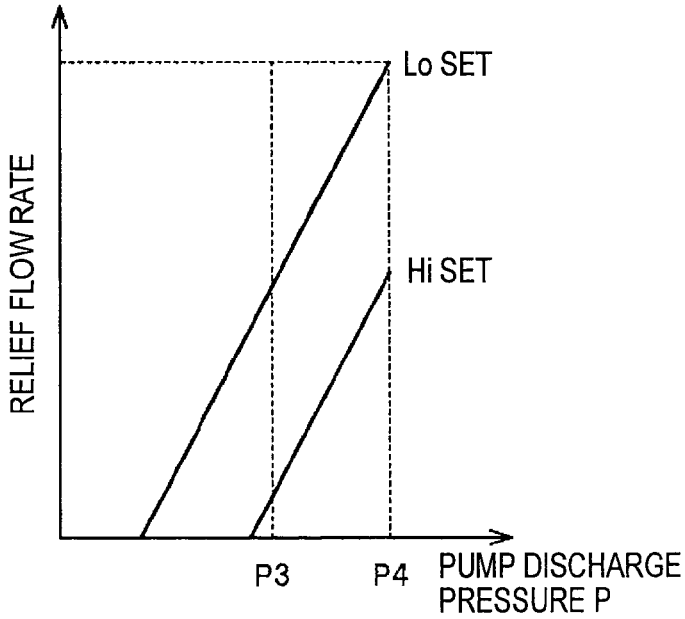
FIG. 10 is a graph showing override characteristics of the two-stage swing relief valve (embodiment).

FIG. 10 shows a relationship between the pump discharge pressure P and the relief flow from two-stage swing relief valve 14, in which the vertical axis represents the relief flow and the horizontal axis represents the pump discharge pressure P.

The first set value Pa and a fifth set pressure Pe, and a torque adjustment amount (i.e. a value of adjustment ratio E) of the pump absorption torque between Pa and Pe can be determined through experiments and the like so that the acceleration of the swing of the upper structure 5 when the swing cutoff is conducted in the same manner as a conventional arrangement in which the swing cutoff is not conducted.

The first set value Pa can be set at a value close to the relief pressure of the two-stage swing relief valve 14 when the relief pressure of the two-stage swing relief valve 14 is set at the high-pressure-side second relief pressure. The fourth set value Pd can be set at a value close to the relief pressure of the two-stage swing relief valve 14 in the conventional arrangement in which the swing cutoff is not conducted.

Until the pump discharge pressure P becomes the first set value Pa, the adjustment ratio E is set at "1". When the pump discharge pressure P reaches or exceeds the fifth set value Pe, the adjustment ratio E may be set at a substantially constant value Emin. The most appropriate value of Emin can be obtained through experiments and the like.

Figure 20:
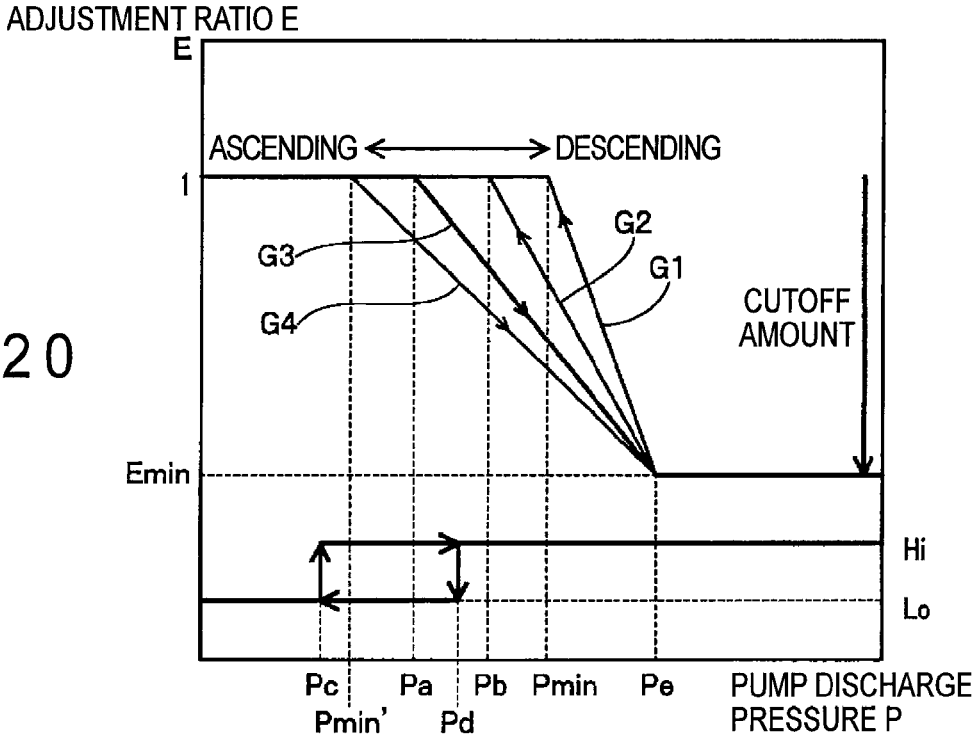
FIG. 20 is a graph showing a relationship between the pump discharge pressure, an adjustment ratio and the relief pressure (embodiment).

When the pump discharge pressure P is between the first set value Pa and the fifth set value Pe, the value of the adjustment ratio E can be set at a value proportional to the pump discharge pressure P. Though the adjustment ratio E is represented in a cubic-functional proportion in FIG. 9, a linearly proportional relationship may be established as shown in FIG. 20 (described later). Alternatively, the adjustment ratio E may be set in a quadratic-functional proportion or according to other functions. The most appropriate proportional relationship can be obtained through experiments and the like.

The difference in set pressures of the high-pressure-side second relief pressure and the low-pressure side first relief pressure of the two-stage swing relief valve 14 can also be obtained through experiments and the like as a value capable of increasing the time in which the swing cutoff is conducted and capable of increasing the torque adjustment amount of the pump absorption torque T during an actual operation.

Figure 11:
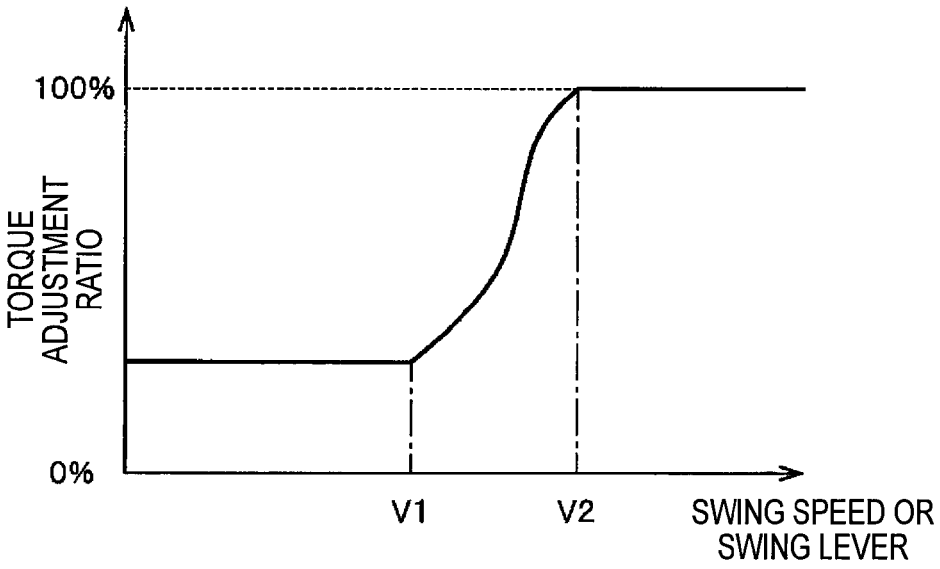
FIG. 11 is a graph showing characteristics of the adjustment-amount command value to the torque control valve (embodiment).

Incidentally, the torque adjustment amount of the pump absorption torque T used in the adjuster 37 may be determined in accordance with the pump discharge pressure P (i.e. obtained based on the pump discharge pressure P through calculation or experiments) as shown in FIG. 9 or, alternatively, may be determined in accordance with the swing velocity of the upper structure 5 and the control lever 18*a* as shown in FIG. 11.

Further, as long as the operability such as the swing acceleration is not deteriorated, one of the torque adjustment ratios with the least adjustment amount may be selected among those determined according to the pump discharge pressure P, the swing velocity of the upper structure 5 and the control lever 18*a*.

Figure 16:
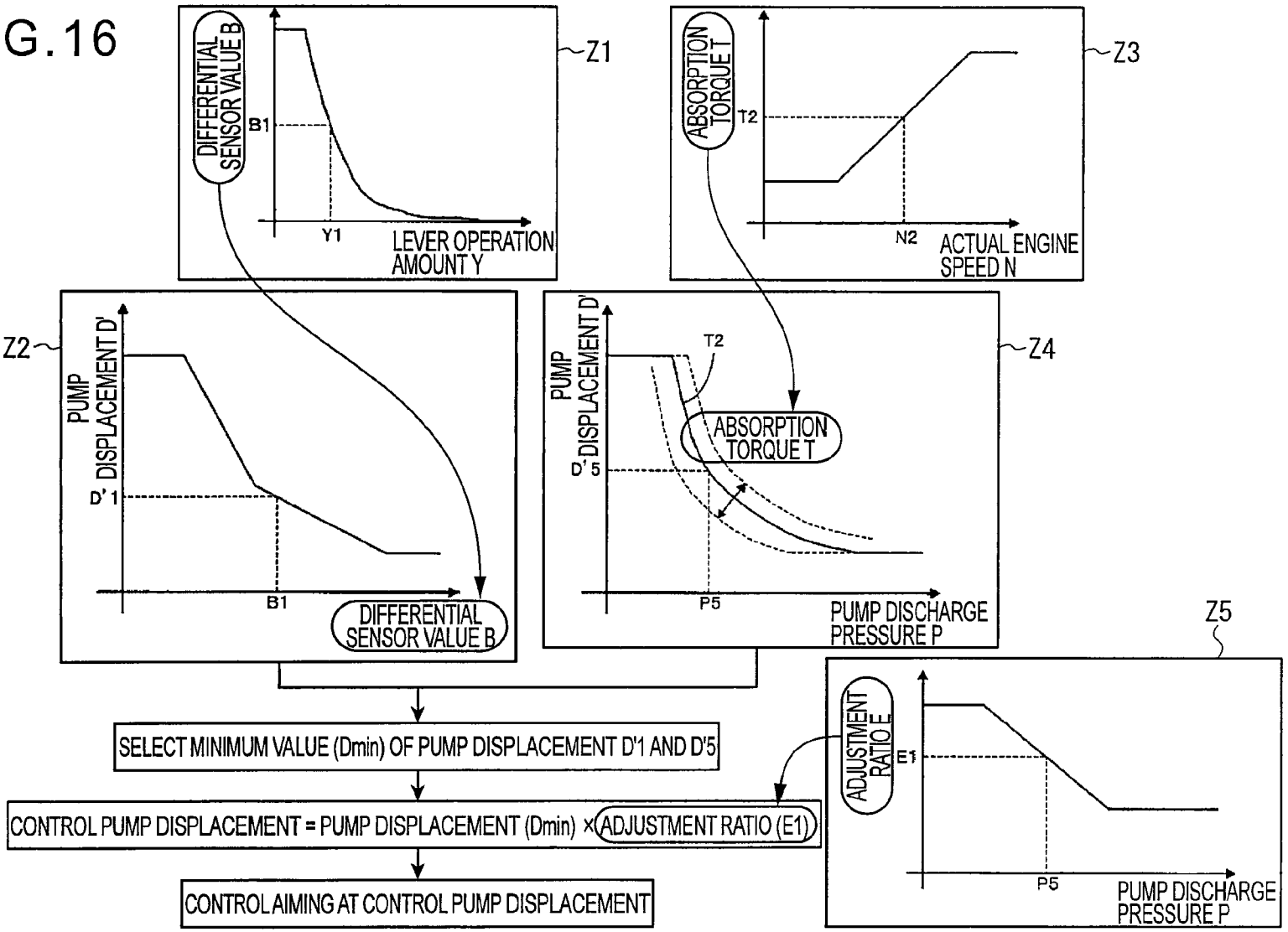
FIG. 16 is a group of graphs showing how a target pump displacement is obtained and how the target pump displacement is adjusted by an adjuster (embodiment).

Though the target pump displacement is calculated based on a relationship between the pump discharge pressure P and the absorption torque T in the above, the target pump displacement for controlling the pump displacement of the hydraulic pumps 6 and 20 including the pump 20 may be obtained through another process. Specifically, a target pump displacement D' as well as an operation amount Y may be obtained based on a relationship between graphs Z1 and Z1 shown in FIG. 16. Incidentally, graphs Z3 and Z4 in FIG. 16 show a process for obtaining the target pump displacement D' based on a relationship between the pump discharge pressure P and the absorption torque T.

The process for obtaining the target pump displacement D' with reference to FIG. 16 will be described with further reference to the hydraulic circuit diagram shown in FIG. 5. The hydraulic circuit shown in FIG. 5 has basically the same arrangement as the hydraulic circuit shown in FIG. 1. Accordingly, the same component used in the hydraulic circuit shown in FIG. 1 will be denoted by the same reference numerals and the description thereof will be omitted.

Though the pump displacement is commanded directly from the controller 7 to the swash plate control valve 21 in the hydraulic circuit shown in FIG. 5, the torque may alternatively commanded from the controller 7 to the swash plate control valve 40 as shown in FIG. 13.

As shown in FIG. 5, the pressure sensor 31 for detecting PPC pressure from the pilot operation valve 18 is provided. Further, in order to detect the operation amount of the control lever 18*a* of the pilot operation valve 18, the swing control valve 34 has six ports. The ports of the swing control valve 34 includes: a port connected to the reservoir 30; two ports connected to the pump 20; two ports respectively connected to the oil paths 45*a* and 45*b* to the hydraulic swing motor 12*a*; and a port connected to the oil path 47 for detecting an operating condition of the swing control valve 34.

A throttle 33 is provided in the oil path 47 connected to the reservoir 30. The differential pressure between the upstream and downstream of the throttle 33 is detected by a differential pressure sensor 32 to detect the operating condition of the swing control valve 34, i.e. the operation amount of the control lever 18*a*. Specifically, the spool of the swing control valve 34 slidably moves by an amount corresponding to the operation amount of the control lever 18*a* to vary the opening area of the port of the swing control valve 34 connected to the oil path 47.

Thus, the flow rate flowing in the oil path 47 varies. At this time, the variation of the flow rate flowing in the oil path 47 can be detected according to the differential pressure between the upstream and downstream of the throttle 33 provided in the oil path 47 that is detected by the differential pressure sensor 32. The operation amount of the control lever 18*a* can be detected according to the detection value of the differential pressure sensor 32.

The oil paths 45*a* and 45*b* connected to the hydraulic swing motor 12*a* are connected to the check valve 22 through the branch points 46*a* and 46*b*, so that the pressure oil in the oil paths 45*a* and 46*b* with higher pressure flows from the check valve 22 through the oil path 45*c* to be discharged to the reservoir 30. The two-stage swing relief valve 14 is disposed in the oil path 45*c*. The two-stage swing relief valve 14 is adapted to switch the relief pressure between the high-pressure-side second relief pressure and the low-pressure-side first relief pressure by the solenoid switch 29.

The graph Z1 in FIG. 16 shows a relationship between the operation amount Y of the control lever 18*a* and the detection value of the differential pressure sensor 32. When the detection value of the differential pressure sensor 32 is B1, it can be recognized that the operation amount Y of the control lever 18*a* is Y1 according to the relationship shown in the graph Z1.

Then, when the control lever 18*a* is operated by the operation amount Y1, the pump displacement of the pump 20 can be controlled to be the target pump displacement D1' in accordance with the relationship between a differential pressure sensor value B and the target pump displacement D' shown in the graph Z2 in FIG. 16.

The graphs Z3 and Z4 shown in FIG. 16 will be described below. The graph Z3 is a graph showing a relationship between an actual engine speed N and the pump absorption torque T. The graph Z4 is a graph showing a relationship between the pump discharge pressure P and the target pump displacement D' with reference to the pump absorption torque T.

As shown in the graph Z3, the pump absorption torque when the actual engine speed is N2 corresponds to a value T2. Further, as shown in the graph Z4, when the pump discharge pressure is P5, the target pump displacement corresponds to D5' on the curve of the pump absorption torque T2. Then, the pump displacement of the pump 20 can be controlled to be the target pump displacement D5'.

At this time, if the value of the target pump displacement D1' when the control lever 18*a* is operated by the operation amount Y1 is smaller or larger than the value of the target pump displacement D5' corresponding to the pump discharge pressure P5, smaller one of the target pump capacities D1' and D5' is used as a target pump displacement Dmin'. By adjusting the target pump displacement of the pump with the swing cutoff based on the target pump displacement Dmin', the extra discharge flow discharged from the two-stage swing relief valve 14 can be reduced.

Accordingly, the magnitude of the value of the target pump displacement D1' when the control lever 18*a* is operated by the operation amount Y1 and the magnitude of the value of the target pump displacement D5' corresponding to the pump discharge pressure P5 are compared to obtain the target pump displacement Dmin' in the invention, based on which the pump displacement of the pump 20 is controlled.

As described above, when the pump discharge pressure P exceeds the first set value Pa, the adjuster 37 is operated to reduce the value of the target pump displacement Dmin'. This process will be described below in detail with reference to FIG. 16. The smaller one of the target pump capacities D1' and D5' is set as the target pump displacement Dmin'. According to a relationship between the pump discharge pressure and the adjustment ratio E shown in a graph Z5, an adjustment ratio E1 corresponding to the pump discharge pressure P5 is obtained.

The adjustment ratio E1 obtained according to the graph Z5 is multiplied by the target pump displacement Dmin' to obtain an adjusted target pump displacement (Dmin'×E1), which is used as a control amount for controlling the pump displacement of the pump 20. Thus, the invention can be suitably applied to a swing drive controlling system in which the controller 7 directly commands the pump displacement to the swash plate control valve 41.

In the above description with reference to FIG. 16, the magnitude of the value of the target pump displacement D1' when the control lever 18*a* is operated by the operation amount Y1 and the magnitude of the value of the target pump displacement D5' corresponding to the pump discharge pressure P5 are compared to obtain the target pump displacement Dmin' (smaller one of D1' and D5'), based on which the pump displacement of the pump 20 is controlled.

However, in the swing cutoff operation in the invention, the pump displacement of the pump 20 may be controlled based solely on the value of the target pump displacement D1' when the control lever 18*a* is operated by the operation amount Y1 or based solely on the value of the target pump displacement D5' corresponding to the pump discharge pressure P5. Further, the swing cutoff operation of the invention is not limited to the pump displacement control of the pump 20, but can be suitably applied to, for instance, a swing drive controlling system in which the controller 7 commands the torque to the swash plate control valve 40 as shown in FIG. 13.

Figure 15:
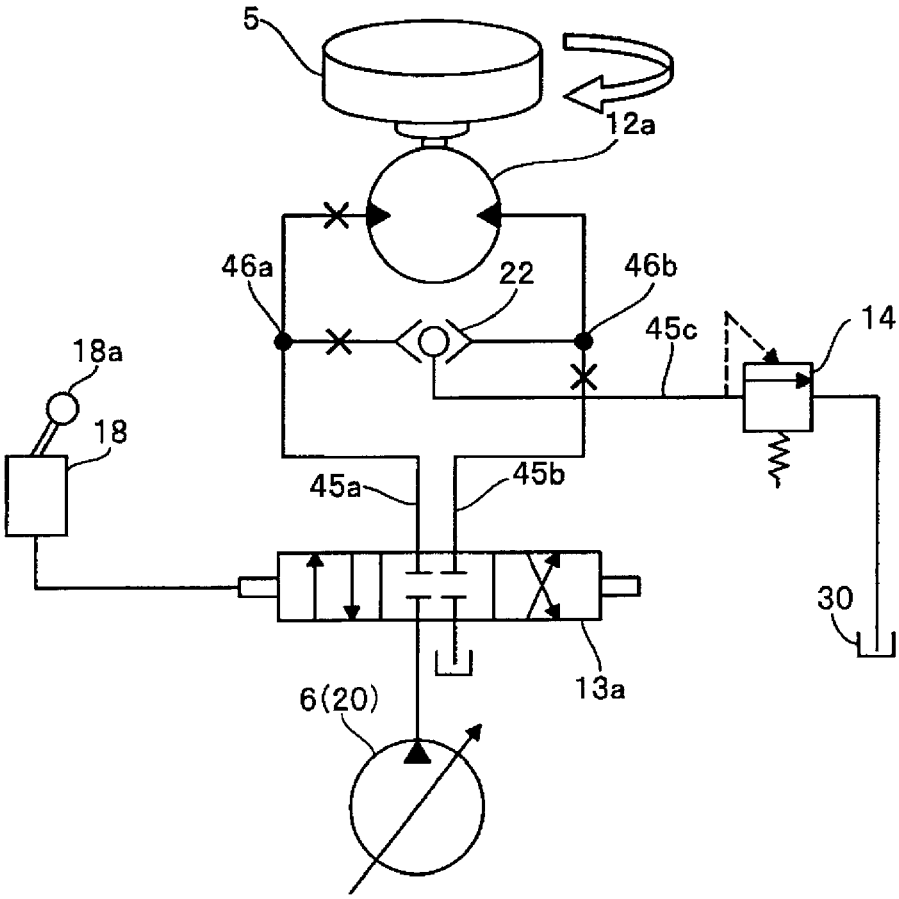
FIG. 15 is another circuit diagram of the primary part showing a condition in which a control lever is suddenly returned during a swing of the tipper structure (embodiment).

Next, sudden return operation and shift-back operation of the control lever 18*a* during the swing control of the upper structure 5 will be described below with reference to FIGS. 5 and 15. At this time, as shown in FIG. 15, since the swing control valve 13*a* is closed, the oil path 45*a* and the oil path 45*b* between the branch point 46*b* and the swing control valve 13*a* are closed.

However, since the upper structure 5 is inclined to rotate on account of inertial force, the oil discharged from the hydraulic swing motor 12*a* flows into the oil path 45*c* from the branch point 46*b* of the oil path 45*b* through the check valve 22.

At this time, when the two-stage swing relief valve 14 is set at the high-pressure-side second relief pressure by the swing cutoff, the pressure on the discharge side of the hydraulic swing motor 12*a* becomes relatively high as compared to a normal condition (i.e. when the two-stage swing relief valve 14 is set at the low-pressure-side first relief pressure).

As a result, the deceleration torque for decelerating the swing of the upper structure 5 that keeps rotating by virtue of the inertial force increases, so that the swing of the upper structure 5 is too rapidly decelerated to cause a deceleration shock or the peak pressure applied to the hydraulic swing motor 12*a* is increased to shorten the lifetime of the hydraulic swing motor 12*a*.

Accordingly, in order to solve the above problems in the invention, when a brake pressure is generated to the hydraulic swing motor 12*a*, the relief pressure of the two-stage swing relief valve 14 is set at the low-pressure-side first relief pressure to slow down the deceleration of the swing of the upper structure 5, thereby preventing the deceleration shock. Further, since the pressure applied to the hydraulic swing motor 12*a* is not raised, the lifetime of the hydraulic swing motor 12*a* is not shortened.

Incidentally, the generation or the possibility of the generation of the brake pressure to the hydraulic swing motor 12*a* can be recognized by detecting the sudden return of the swing control valve 13*a* in a neutral direction or shift-back of the swing control valve 13*a* based on the pilot pressure from the pilot operation valve 18 by the pressure sensor 31, by detecting the operation angle of the control lever 18*a* (the operation angle can be detected by providing an angle sensor to the pilot operation valve 18), or by detecting the rotation of the swing shaft of the upper structure 5 by a swing velocity sensor (not shown).

Accordingly, a lever-return determining unit 42 can be provided so that an operator's tendency for stopping the swing of the upper structure 5 (i.e. deceleration of the upper structure) and a transition of the swing movement of the upper structure 5 from the accelerated/steady swing state to the deceleration state can be detected by the controller 7.

When such a transition to the deceleration is determined by the controller 7, the controller 7 outputs a signal for stopping the swing cutoff to the electric proportional pressure control valve 11 as shown in FIG. 5 and outputs a control signal to the solenoid switch 29 to set the relief pressure of the two-stage swing relief valve 14 to the first relief pressure Lo on the low-pressure side. Accordingly, the above-described problem caused by the swing cutoff can be solved.

In the above description, it is specified that the relief pressure of the two-stage swing relief valve 14 can be set in two stages (i.e. the low-pressure-side first relief pressure and the high-pressure-side second relief pressure). However, the two-stage swing relief valve 14 may be provided by a valve capable of setting the relief pressure in a stepless manner in accordance with the pilot pressure introduced into the two-stage swing relief valve 14, i.e. a variable relief valve.

When the two-stage swing relief valve 14 is provided by a variable relief valve, the solenoid valve for changing the relief pressure of the two-stage swing relief valve 14 may be provided by a electric proportional pressure control valve in place of the solenoid switch 29, thereby allowing more minute pressure setting. Thus, the pressure waveform during the swing that has been realized in a conventional arrangement can be accurately reproduced during the swing cutoff operation.

Figure 17:
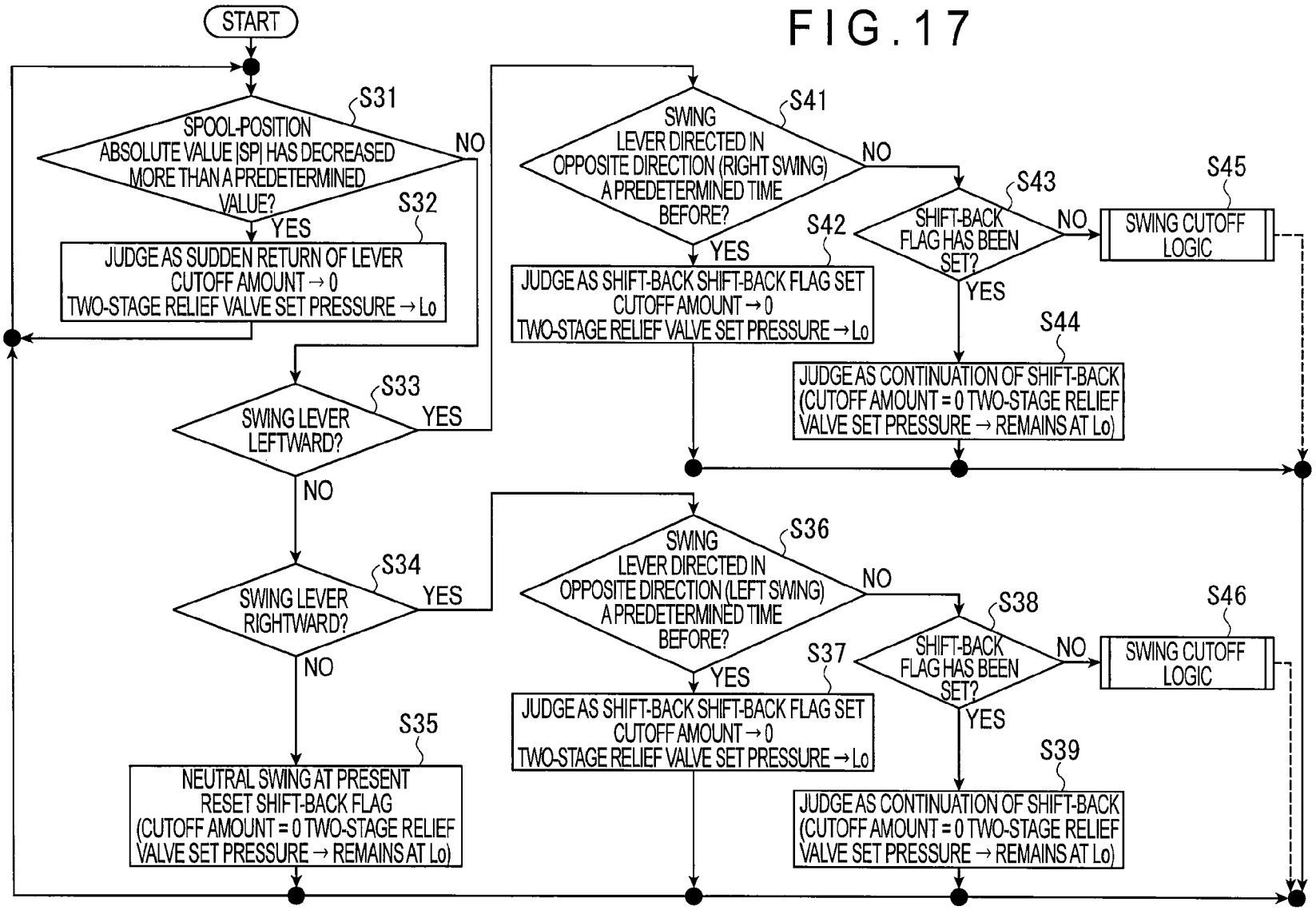
FIG. 17 is a control flowchart for judging a sudden return of the control lever (embodiment).

Next, the determination of sudden return operation or shift-back of the control lever 18*a* will be described below with reference to the control flowchart in FIG. 17 and further reference to FIG. 5.

In step S31, whether the absolute position of the spool of the swing control valve 34 decreases by more than a predetermined value or not is judged. Specifically, whether an absolute value of a difference between an output of the pressure sensor 31 for detecting the output pressure of the control lever 18*a* and an output of a pressure sensor (not shown) for detecting the output pressure of the control lever 18*a* in an opposite direction has decreased by more than the predetermined value or not is judged by the lever-return determining unit 42 and a lever-shift-back determining unit 43 provided in the controller 7. In other words, whether the sudden return operation or shift-back operation of the control lever 18*a* has been conducted or not is judged.

When it is judged in step S31 that the absolute position of the spool of a swing control valve spool 34 has decreased by more than the predetermined value, the process advances to step S32. When it is judged that the absolute position of the spool of a swing control valve spool 34 has not decreased by more than the predetermined value, the process advances to step S33.

In step S32, judging that the sudden return operation or the shift-back operation of the control lever 18*a* has been conducted, a cutoff amount (i.e. a remnant of flow, from which the flow discharged from the relief valve is subtracted when the swing cutoff of the invention is conducted) is controlled to be zero and the relief pressure of the two-stage swing relief valve 14 is set at the low-pressure-side first relief pressure Lo.

Accordingly, the deceleration of the swing of the upper structure 5 can be slowed down, thereby avoiding the generation of the deceleration shock and extending the lifetime of the hydraulic swing motor 12*a*.

When the control process in step S32 is ended, the process returns back to step S31 and the process starting from step S31 is repeated.

In step S33, whether the control lever 18*a* is operated leftward or not is judged. When it is judged that the control lever 18*a* is operated leftward in step S33, the process advances to step S41. When it is judged that the control lever 18*a* is not operated leftward in step S33, the process advances to step S34.

Incidentally, the leftward operation of the control lever 18*a* can be detected by the sliding direction of the spool of the swing control valve 34 shown in FIG. 5. Specifically, though FIG. 5 only the pressure sensor 31 for detecting the PPC pressure applied on an end of the spool of the swing control valve 34, another pressure sensor (not shown) for detecting the PPC pressure applied on the other end of the spool of the swing control valve 34 is also provided. Using both of the pressure sensors, the direction in which the control lever 18*a* is operated can be detected.

In step S34, whether the control lever 18*a* is operated rightward or not is judged. When it is judged that the control lever 18*a* is operated rightward in step S34, the process advances to step S36. When it is judged that the control lever 18*a* is not operated rightward in step S34, the process advances to step S35.

In step S35, judging that the control lever 18*a* is situated at a neutral position at present, a shift-back flag is reset. At this time, the cutoff amount is kept at zero and the relief pressure of the two-stage swing relief valve 14 is kept at the low-pressure-side first relief pressure Lo. When the control process in step S35 is ended, the process returns back to step S31 and the process starting from step S31 is repeated.

In step S36, whether the operating direction of the control lever 18*a* before a predetermined time was opposite (i.e. leftward) to the current operating direction is judged by an elapsed time judging unit 50 provided in the adjuster 37. When it is judged that the operating direction of the control lever 18*a* a predetermined time before was opposite to the current operating direction in step S36, the process advances to step S37. When it is judged that the operating direction of the control lever 18*a* a predetermined time before was not opposite to the current operating direction, the process advances to step S38.

In step S37, judging that the control lever 18*a* is shilling back, a shift-back flag is set. At this time, the cutoff amount is kept at zero and the relief pressure of the two-stage swing relief valve 14 is kept at the low-pressure-side first relief pressure Lo. When the control process in step S37 is ended, the process returns back to step S31 and the process starting from step S31 is repeated.

In step S38, whether the shift-back flag is set or not is judged. When it is judged that the shift-back flag is set in step S38, the process advances to step S39. When it is judged that the shift-back flag is not set in step S38, the process advances to step S46.

In step S39, it is judged that the shift-back of the control lever 18 is going on. At this time, the cutoff amount is kept at zero and the relief pressure of the two-stage swing relief valve 14 is kept at the low-pressure-side first relief pressure Lo. When the control process in step S39 is ended, the process returns back to step S31 and the process starting from step S31 is repeated.

In step S46, normal swing cutoff operation and switching operation of the set pressure of the two-stage swing relief valve 14 are performed. Then, the process returns back to step S31 and the process starting from step S31 is repeated.

In step S41, whether the operating direction before a predetermined time was opposite (i.e. rightward) to the current operating direction or not is judged. When it is judged that the operating direction of the control lever 18*a* a predetermined time before was opposite to the current operating direction in step S41, the process advances to step S42. When it is judged that the operating direction of the control lever 18*a* a predetermined time before was not opposite to the current operating direction, the process advances to step S43.

In step S42, judging that the control lever 18*a* is shifting back, a shift-back flag is set. At this time, the cutoff amount is kept at zero and the relief pressure of the two-stage swing relief valve 14 is kept at the low-pressure-side first relief pressure Lo. When the control process in step S42 is ended, the process returns back to step S31 and the process starting from step S31 is repeated.

In step S43, whether the shift-back flag is set or not is judged. When it is judged that the shift-back flag is set in step S43, the process advances to step S44. When it is judged that the shift-back flag is not set in step S43, the process advances to step S45.

In step S44, it is judged that the shift-back of the control lever 18 is going on. At this time, the cutoff amount is kept at zero and the relief pressure of the two-stage swing relief valve 14 is kept at the low-pressure-side first relief pressure. When the control process in step S44 is ended, the process returns back to step S31 and the process starting from step S31 is repeated.

In step S45, normal swing cutoff operation and switching operation of the set pressure of the two-stage swing relief valve 14 are performed. Then, the process returns back to step S31 and the process starting from step S31 is repeated.

Next, description will be made on a delay of the response characteristics of the target pump displacement in a direction for reducing the pump displacement after a predetermined time is elapsed from the start of the cutoff in the invention.

When the pump displacement D of the pump 20 or the hydraulic pump 6 (referred to as hydraulic pump displacement D hereinafter) is controlled using the target pump displacement D' in order to perform the swing cutoff, the pump discharge pressure P fluctuates. When the pump discharge pressure P suddenly fluctuates for some reason, the value of the target pump displacement D' for controlling the pump displacement D of the pump 20 or the hydraulic pump 6 also fluctuates.

When the hydraulic pump displacement D is controlled based on the fluctuating target pump displacement D', the fluctuation of the hydraulic pump displacement D to be controlled is amplified by the fluctuating target pump displacement D' to be magnified. As a result, the pump discharge pressure P is further greatly fluctuated, so that the cutoff operation in which the discharge flow relieved from the two-stage swing relief valve 14 is suppressed cannot be conducted.

Thus, the response characteristics of the target pump displacement D' is delayed in the invention. With the above feature, a delay of the swing cutoff is prevented when the upper structure 5 starts swing. Further, the pressure fluctuation of the pump discharge pressure P by conducting the swing cutoff can also be prevented. Output control of the target pump displacement D' (i.e. whether the response characteristics of the target pump displacement D' is delayed or not) is conducted by a response characteristics setting unit 51 provided in the adjuster 37.

Figure 18:
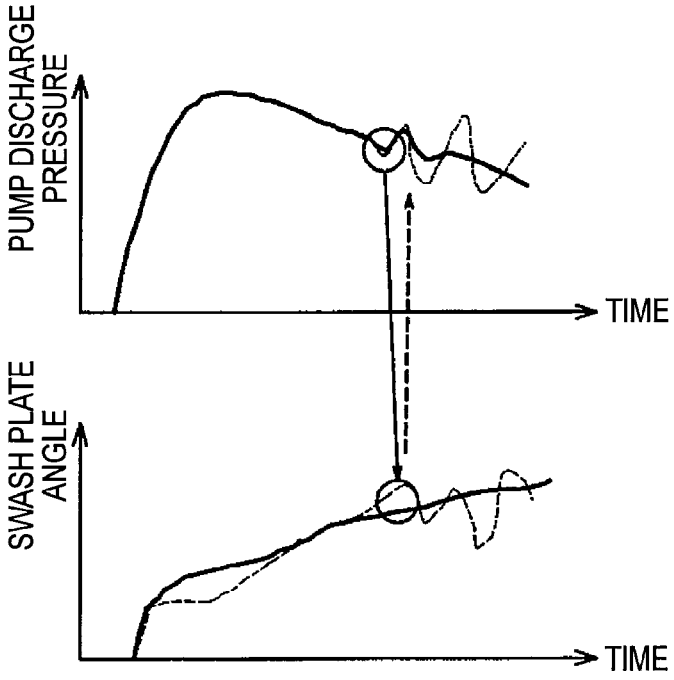
FIG. 18 is a group of graphs showing details of pump discharge pressure and swash plate angle when response characteristics are delayed and the response characteristics are not delayed.
Figure 19:
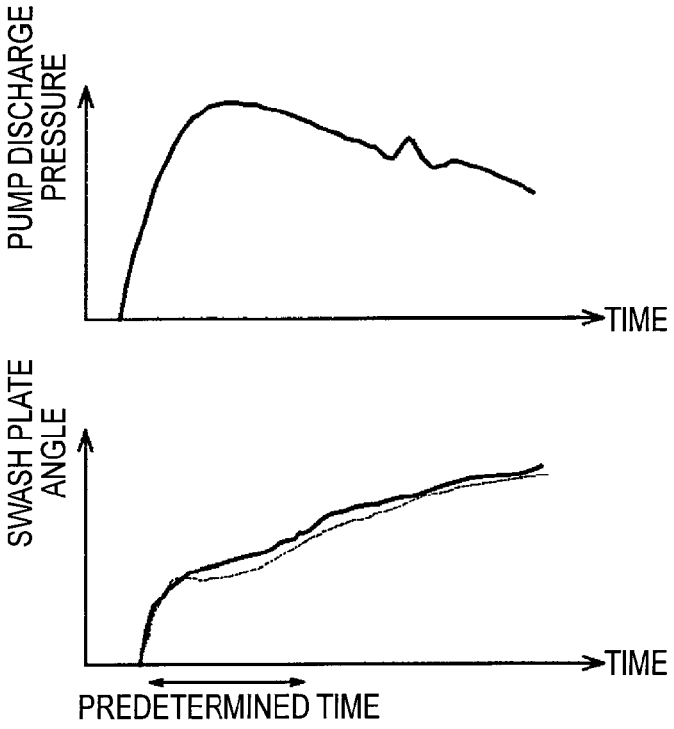
FIG. 19 is a group of graphs showing details of the pump discharge pressure and the swash plate angle effected by delaying the response characteristics.

Outputting the target pump displacement D' with/without the delayed response characteristics will be described with reference to FIGS. 18 and 19. In FIGS. 18 and 19, the upper graph shows a temporal variation of the pump discharge pressure P. The lower graph shows the temporal variation of the swash plate angle of the hydraulic pump after conducting the swing cutoff.

The dotted line in FIGS. 18 and 19 shows a state of not delaying the response characteristics and the solid line shows a state of delaying the response characteristics. FIG. 19 shows an arrangement in which the response characteristics are delayed only to a signal of the target pump displacement for increasing the hydraulic pump displacement D for a predetermined time after starting the cutoff.

In contrast, the response characteristics are not delayed in response to a signal of the target pump displacement for decreasing the hydraulic pump displacement D for the predetermined time after starting the cutoff. FIG. 19 also shows that, after the predetermined time elapsed after starting the cutoff, the response characteristics are delayed in response to a signal of the target pump displacement for increasing the pump displacement.

As shown in dotted line in FIG. 18, without delaying the response characteristics of the target pump displacement in accordance with the fluctuation of the pump discharge pressure P, the swash angle controlled based on the signal of the target pump displacement also fluctuates in an opposite phase in accordance with the fluctuation of the pump discharge pressure P. The fluctuation is magnified in accordance with the elapsed time.

In contrast, when the response characteristics of the target pump displacement are delayed in accordance with the fluctuation of the pump discharge pressure P as shown in the solid line in FIG. 18, the fluctuation of the pump discharge pressure P can be absorbed, so that the fluctuation of the pump discharge pressure P can be smoothed.

As shown in the lower graph in FIG. 19, when the response characteristics in response to the target pump displacement signal for decreasing the hydraulic pump displacement D are delayed within the predetermined time after starting the swing cutoff, the cutoff amount runs short immediately after starting the swing cutoff. Specifically, in the area (predetermined time) in FIG. 19, the swash plate 20*a* of the pump 20 is controlled as shown in the solid line, so that the hydraulic pump displacement D tends to be increased and the discharge flow from the hydraulic pump becomes excessive.

Accordingly, in the invention, within the predetermined time after starting the swing cutoff, the adjusted response characteristics are not delayed in response to the signal of the target pump displacement D' in a direction for decreasing the swash plate angle of the hydraulic pump, thereby applying the control shown by the dotted line on the swash plate 20*a* of the pump 20 in the area (predetermined time) shown in FIG. 19 and avoiding the delay of the cutoff operation. Hence, the cutoff amount shortage can be avoided.

After the predetermined time is elapsed after the swing cutoff is started, the response characteristics in response to the signal of the target pump displacement D' for increasing and reducing the pump displacement of the pump 20 are delayed, so that the pump displacement of the pump 20 can be controlled while removing the fluctuation of the target pump displacement D'. Thus, a large fluctuation of the pump displacement of the pump 20 can be prevented.

Further, the pressure fluctuation due to the swing cutoff can be prevented and the fluctuation of the pump discharge pressure can be restrained. In addition, since the delay of the cutoff operation in response to the increase in the pump discharge pressure P can be prevented, the discharge flow to be relieved can be restrained.

Next, the relationship between the first, second and third set values Pa, Pb and Pc and the adjustment ratio E for adjusting the target pump displacement D' by the adjuster 37 will be described below with reference to FIGS. 20 and 21.

FIG. 20 shows the relationship between the pump discharge pressure P and the adjustment ratio E and the relationship between the relief pressure of the two-stage swing relief valve 14 and the pump discharge pressure P (also shown in FIG. 8).

In FIGS. 8 and 9, the first set value Pa is a fixed value. However, with the fixed first set value Pa, when the increase rate of the pump discharge pressure P is high, the adjusted target pump displacement D' cannot catch up with the change in the pump discharge pressure P even when the target pump displacement D' is adjusted using the adjustment ratio E by the adjuster 37, so that the hydraulic pump displacement D is controlled with some delay.

Thus, even when the hydraulic pump displacement D is controlled in view of the current pump discharge pressure P, the cutoff amount runs short when the increase rate of the pump discharge pressure P is high, so that sufficient improvement in fuel consumption cannot be obtained.

When the pump discharge pressure P increases to the third set value Pc, the low-pressure-side first relief pressure Lo is switched to and is kept at the high-pressure-side second relief pressure Hi. When the pump discharge pressure P falls below the fourth set value Pd, the relief pressure of the two-stage swing relief valve 14 is switched from the high-pressure-side second relief pressure Hi to be kept at the low-pressure side first relief pressure Lo.

At this time, since the third set value Pc is smaller than the minimum value (Pmin') of the first set value Pa, even when the increase rate of the pump discharge pressure P is high and the first set value Pa is changed close to the minimum value (Pmin'), a relationship of (the third set value Pc)<(the first set pressure Pa) can be maintained.

Further, since the fourth set value Pd is set at a value smaller than the second set value Pb, a relationship of (the fourth set value Pd)<(the second set pressure Pb) can be maintained. Alternatively, the fourth set value Pd may be reset in accordance with the second set value Pb so that the fourth set value Pd becomes smaller than the second set value Pb. With the above arrangement, since the set pressure of the two-stage swing relief valve 14 is not switched during the swing cutoff operation, stable swing drive control is possible.

Accordingly, in view of the variation of the pump discharge pressure P, the first set value Pa is set small when the increase rate of the pump discharge pressure P is high. In graphs G1 to G4 in FIG. 20 showing the relationship between the pump discharge pressure P and the adjustment ratio E, supposing that the graph G3 represents an instance where the first set value Pa is fixed, when the increase rate of the pump discharge pressure P is high, the first set value Pa is shifted to the side of Pmin' to be set as shown in the graph G4.

Incidentally, when the pump discharge pressure P is increasing, the value of the adjustment ratio E in FIG. 20 varies in a direction to be decreased from "1" (100%) toward Emin to be kept at Emin. In contrast, when the pump discharge pressure P is decreasing, the value of the adjustment ratio E varies in a direction to be increased from Emin toward "1" (100%) to be kept at 1.

Accordingly, the target pump displacement D' can be adjusted by the adjuster 37 and, therefore, even when the increase rate of the pump discharge pressure P is high, the hydraulic pump displacement can be controlled to conduct the swing cutoff without causing temporal delay.

When the pump discharge pressure is decreasing at a higher decreasing rate, the second set value Pb is shifted toward Pmin. For instance, supposing that the graph G2 represents an instance in which the second set value Pb is fixed, when the deceleration rate is high, the second set value Pb is shifted toward Pmin' to be set as shown in graph G1. In other words, the adjustment ratio is made to quickly return to "1" when the decreasing rate of the pump discharge pressure P is high, thereby quickly returning to a state in which the swing cutoff is not conducted.

At this time, in the graph at a lower part of FIG. 20 showing the relationship between the relief pressure of the two-stage swing relief valve 14 and the pump discharge pressure P, the first set value Pa or the second set value Pb is shifted toward Pmin' or Pmin in accordance with the increase/decrease rate of the pump discharge pressure P under a condition that: a value obtained by subtracting from the current pump discharge pressure P(t) the pump discharge pressure P(t−Δt) (i.e. temporal difference ΔP of pump discharge pressure P) before, for instance, 0.1 second, exceeds a predetermined threshold in increasing the pump discharge pressure P; or falls below a predetermined threshold in decreasing the pump discharge pressure P.

Then, in accordance with the temporal difference ΔP, the first set value Pa or the second set value Pb is set. The higher the increase rate of the pump discharge pressure P is (i.e. the larger ΔP is), the smaller the first set value Pa becomes. Thus, the cutoff rate can be increased (i.e. the relief flow can be reduced) as compared with an instance in which the first set value Pa is fixed for the same pump discharge pressure P.

Figure 21:
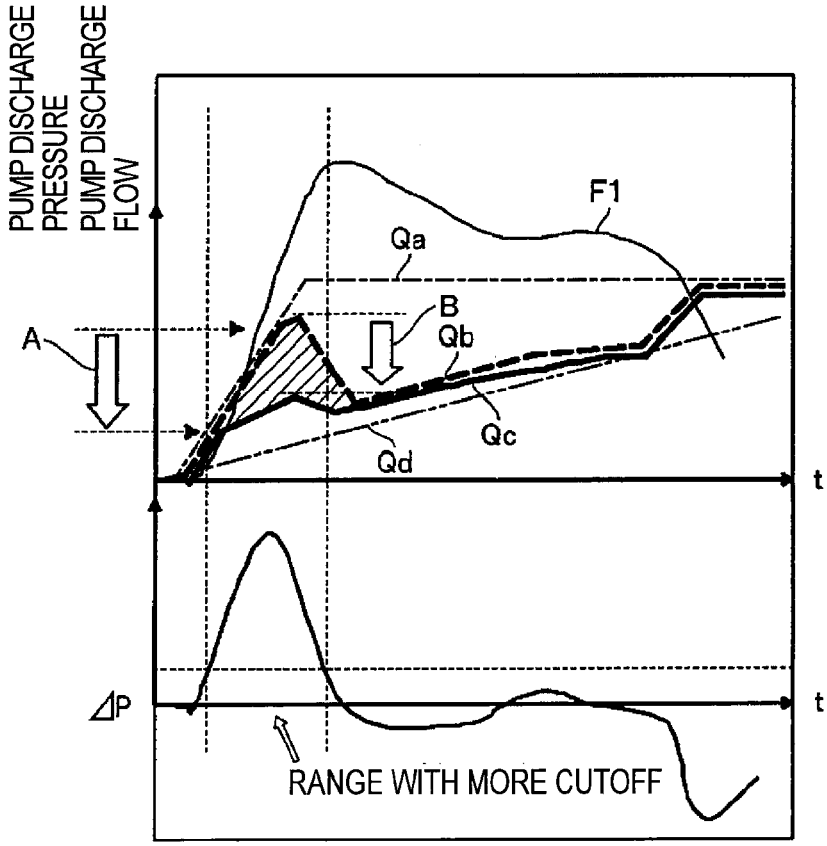
FIG. 21 is a graph showing a temporal variation of the pump discharge pressure and the pump flow rate (embodiment).

FIG. 21 shows the temporal variations of the pump discharge flow Q in which the first set value Pa is shifted/not shifted toward Pmin' in accordance with the increase/decrease rate of the pump discharge pressure P. The solid line shows the temporal variation of the pump discharge pressure P. The dashed line shows the temporal variation of a pump discharge flow Qa when the swing cutoff is not conducted.

The bold dotted line shows the temporal variation of a pump discharge flow Qb when the first set value Pa is fixed. The bold line shows the temporal variation of a pump discharge flow Qc when the first set value Pa is shifted toward Pmin' in accordance with the increase/decrease rate of the pump discharge pressure P. The dashed-two dotted line shows the temporal variation of an ideal pump discharge flow Qd.

When the first set value Pa is shifted toward Pmin' in accordance with the increase/decrease rate of the pump discharge pressure P, the pump discharge flow can be made closer to the ideal pump discharge flow Qd as compared to the instance in which the first set value Pa is not shifted. Further, as shown by an arrow A, the swing cutoff can be initiated at an early stage. In addition, the value of the adjustment ratio E can be reduced as shown by an arrow B.

Thus, as shown in a hatched area surrounded by the pump discharge flow Qb and the pump discharge flow Qd, when the first set value Pa is shifted toward Pmin' in accordance with the increase/decrease rate of the pump discharge pressure P, the cutoff amount can be increased as compared to the instance in which the first set value Pa is not shifted toward Pmin'.

As described above, the swing cutoff can be started without delay at the start of the swing of the upper structure 5, thus improving fuel reduction efficiency without changing the operability of the upper structure 5.

Though a hydraulic excavator is exemplified in the above description, the invention is not only applicable to a hydraulic excavator but is also suitably applicable to any construction machine having a swing body, which includes, for instance, crawler hydraulic excavator, wheel hydraulic excavator and crane vehicle.

With the above arrangement, the energy loss that is caused in conjunction with relief operation in accelerating the swing can be reduced substantially without changing the currently installed hydraulic devices, thereby improving the fuel consumption rate, reducing the temperature of hydraulic oil and reducing relief noise.

The invention claimed is:

1. A swing drive controlling system of a construction machine, comprising:

a variable displacement hydraulic pump that is driven by an engine, the variable displacement hydraulic pump supplying a pressure oil to a hydraulic actuator;

a pressure sensor that detects a pump discharge pressure from the variable displacement hydraulic pump;

a control valve that controls a supply of the pressure oil discharged by the hydraulic pump to the hydraulic actuator;

a controller that controls a pump displacement of the variable displacement hydraulic pump;

a hydraulic motor provided by a part of the hydraulic actuator, the hydraulic motor rotating an upper structure of the construction machine;

a swing relief valve that defines a relief pressure of the hydraulic motor; and a control lever that switches a first control valve for the hydraulic motor that is provided by a part of the control valve, wherein the controller determines, while the control lever is operated, whether or not an adjustment of a pump absorption torque defined by a product of the pump displacement and the pump discharge pressure is to be conducted and whether or not the adjustment of the pump absorption torque of the variable displacement hydraulic pump is to be cancelled, based on the pump discharge pressure detected by the pressure sensor, and wherein the controller comprises:

an adjuster that, when the controller determines that the pump discharge pressure detected by the pressure sensor exceeds a first set value, conducts the adjustment to reduce the pump displacement in accordance with the pump discharge pressure and to adjust the pump absorption torque to be set at a value less than a predetermined value; and a canceller that cancels the adjustment by the adjuster when the controller determines that the pump discharge pressure detected by the pressure sensor falls below a second set value that is larger than the first set value.

2. The swing drive controlling system of the construction machine according to claim 1, wherein:

the swing drive controlling system further comprises a lever operation amount detector that detects a lever operation amount of the control lever;

the swing relief valve is a two-stage swing relief valve that is adapted to set a first relief pressure and a second relief pressure higher than the first relief pressure;

the swing drive controlling system further comprises a solenoid switch that switches a set pressure of the two-stage swing relief valve;

the controller further comprises:

a determining unit that determines that the upper structure is accelerating based on the lever operation amount detected by the lever operation amount detector and the pump discharge pressure detected by the pressure sensor; and a swing relief pressure switch that: (i) when the pump discharge pressure detected by the pressure sensor exceeds a third set value, switches the set pressure of the two-stage swing relief valve from the first relief pressure to the second relief pressure, and (ii) when the pump discharge pressure detected by the pressure sensor falls below a fourth set value, switches the relief pressure of the two-stage swing relief valve from the second relief pressure to the first relief pressure;

the third set value is smaller than the first set value, the fourth set value is equal to or smaller than the second set value; and the solenoid switch switches the set pressure of the two-stage swing relief valve based on a switching signal from the swing relief pressure switch.

3. The swing drive controlling system of the construction machine according to claim 1, wherein, when a second control valve other than the first control valve for the hydraulic motor is switched while the adjuster of the controller is reducing the pump displacement in accordance with the pump discharge pressure detected by the pressure sensor and adjusting the pump absorption torque of the variable displacement hydraulic pump to be set at the value less than the predetermined value, the controller cancels the adjustment by the adjuster.

4. The swing drive controlling system of the construction machine according to claim 2, wherein the controller further comprises a lever-return determining unit that judges whether or not the control lever for switching the first control valve for the hydraulic motor is returned in a neutral direction while the control lever is operated, and when the lever-return determining unit judges that the control lever for switching the first control valve for the hydraulic motor is returned in the neutral direction while the control lever is operated, the swing relief pressure switch switches the set pressure of the two-stage swing relief valve that is set at the second relief pressure to the first relief pressure.

5. The swing drive controlling system of the construction machine according to claim 2, wherein the controller further comprises a lever-shift-back determining unit that judges whether or not the control lever for switching the first control valve for the hydraulic motor is operated beyond a neutral position in an opposite direction while the control lever is operated, and when the lever-shift-back determining unit judges that the control lever for switching the first control valve for the hydraulic motor is operated beyond the neutral position in the opposite direction while the control lever is operated, the swing relief pressure switch switches the set pressure of the two-stage swing relief valve that is set at the second relief pressure to the first relief pressure.

6. The swing drive controlling system of the construction machine according to claim 2, wherein, when a second control valve other than the first control valve for the hydraulic motor is switched while the adjuster of the controller is reducing the pump displacement in accordance with the pump discharge pressure detected by the pressure sensor and adjusting the pump absorption torque of the variable displacement hydraulic pump to be set at the value less than the predetermined value, the controller cancels a switching from the first relief pressure to the second relief pressure by the swing relief pressure switch.

7. The swing drive controlling system of the construction machine according to claim 1, wherein the adjuster comprises:

an elapsed time judging unit that judges whether or not a time elapsed since the pump discharge pressure exceeded the first set value is within a predetermined time; and a response characteristics setting unit that sets response characteristics of the pump displacement in response to the pump discharge pressure, wherein the response characteristics setting unit sets the response characteristics in a direction for reducing the pump displacement in response to a change in the pump discharge pressure so that the response characteristics are delayed after the predetermined time has elapsed relative to the response characteristics before the predetermined time has elapsed.

* * * * *